US006814225B2

(12) United States Patent
Belden, Jr. et al.

(10) Patent No.: US 6,814,225 B2
(45) Date of Patent: Nov. 9, 2004

(54) SECURITY SLEEVE FOR RECORDED MEDIA STORAGE CONTAINERS

(75) Inventors: Dennis D. Belden, Jr., Canton, OH (US); Alan J. Parris, Wooster, OH (US); Nicholas M. Sedon, Massillon, OH (US)

(73) Assignee: Alpha Security Products, Inc, Charlotte, NC (US)

( * ) Notice: Subject to any disclaimer, the term of this patent is extended or adjusted under 35 U.S.C. 154(b) by 0 days.

(21) Appl. No.: 10/357,003

(22) Filed: Feb. 3, 2003

(65) Prior Publication Data

US 2003/0234191 A1 Dec. 25, 2003

(Under 37 CFR 1.47)

Related U.S. Application Data

(63) Continuation of application No. 09/833,366, filed on Apr. 12, 2001, now abandoned.

(60) Provisional application No. 60/196,828, filed on Apr. 13, 2000, and provisional application No. 60/239,336, filed on Oct. 11, 2000.

(51) Int. Cl.[7] ..... A45C 13/18; B65D 85/57

(52) U.S. Cl. ..... 206/1.5; 206/387.11; 206/308.2; 206/807; 220/324; 220/326; 220/265; 220/DIG. 20; 292/80

(58) Field of Search ..... 206/1.5, 308.1–312, 206/387.11; 220/324, 326, 265, DIG. 20; 292/80

(56) References Cited

U.S. PATENT DOCUMENTS

| | | | | | |
|---|---|---|---|---|---|
| 4,381,836 | A | * | 5/1983 | Rivkin et al. | 206/387.11 |
| 4,718,547 | A | * | 1/1988 | MacTavish | 206/308.2 |
| 4,782,977 | A | * | 11/1988 | Watanabe et al. | 220/324 |
| 4,881,645 | A | * | 11/1989 | Smiler et al. | 206/387.1 |
| 5,147,034 | A | * | 9/1992 | Broadhead et al. | 206/1.5 |
| 5,454,932 | A | * | 10/1995 | Tardif et al. | 206/387.1 |
| 5,882,052 | A | * | 3/1999 | Whitehead | 292/80 |

* cited by examiner

*Primary Examiner*—Jila M. Mohandesi
(74) *Attorney, Agent, or Firm*—Sand & Sebolt

(57) ABSTRACT

A security sleeve for merchandise storage containers includes a frame that defines a storage compartment. The frame defines an insertion opening through which the merchandise is loaded into the storage compartment. The frame may be configured to hold any of a variety of merchandise packages including various items of recorded media such as video cassettes, CDs, and DVDs. The sleeve includes at least one locking member that blocks a portion of the insertion opening to prevent the merchandise from being removed from the storage compartment until the frame is destroyed.

17 Claims, 30 Drawing Sheets

SECURITY SLEEVE FOR RECORDED MEDIA STORAGE CONTAINERS

CROSS REFERENCE TO RELATED APPLICATIONS

This application is a continuation application claiming priority from U.S. patent application Ser. No. 09/833,366 filed Apr. 12, 2001, now abandoned which claims priority from U.S. provisional patent application Ser. Nos. 60/196,828 filed Apr. 13, 2000, and 60/239,336 filed Oct. 11, 2000; the disclosures of which are incorporated herein by reference.

BACKGROUND OF THE INVENTION

1. Technical Field

The present invention generally relates to security storage containers and, more particularly, to a security device used to hold and display recorded media storage containers. Specifically, the present invention relates to a sleeve that allows a storage container such as a DVD case to be slid into the storage container and then securely retained until the security container is destroyed.

2. Background Information

Numerous items of recorded media are displayed in storage containers for sale to consumers at retail establishments. Consumers demand access to the items of recorded media so that they may review the packaging information while deciding whether or not to purchase the item of recorded media. Retail establishments desire to provide customers access to the items of recorded media while preventing shoplifting. Retail establishments thus place an electronic article security tag (EAS tag) inside or attached to each item of recorded media. The retail establishment then places each tagged item of recorded media inside a security device that prevents the shoplifter from removing the EAS tag from the item of recorded media.

Various types of security devices are known in the art. Some types are reusable and may be opened with special keys by the sales clerk. Other types of security containers known in the art are only used once. The sales clerk either destroys the container when removing the item of recorded media or sells the security device to the consumer along with the item of recorded media after deactivating the EAS tag.

The security container art desires a security container for holding storage containers for items of recorded media that can be easily loaded and locked by automated equipment. The security storage container must allow the consumer to clearly view the front, sides, and rear of the storage container. The security storage container must also prevent easy access to the storage container in order to frustrate shoplifters. The art also desires the security storage containers to be inexpensive to purchase especially when the security storage containers are sold to the consumer. The retail establishments also desire that the security storage containers not consume valuable shelf space.

SUMMARY OF THE INVENTION

In view of the foregoing, the present invention provides a security storage container that may be used to hold a storage container for an item of recorded media in a manner that allows all sides of the storage container to be viewed by the consumer.

The present invention also provides a security storage container that may be easily loaded by automated equipment.

The present invention also provides a security storage container having relatively thin walls such that the container does not increase the required shelf space for the storage container.

The present invention also provides a security storage container that successfully frustrates potential shoplifters by preventing easy access to the recorded media storage container.

BRIEF DESCRIPTION OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended claims.

Similar numbers refer to similar parts throughout the specification.

DESCRIPTION OF THE PREFERRED EMBODIMENTS

Figures 1, 2, 3:
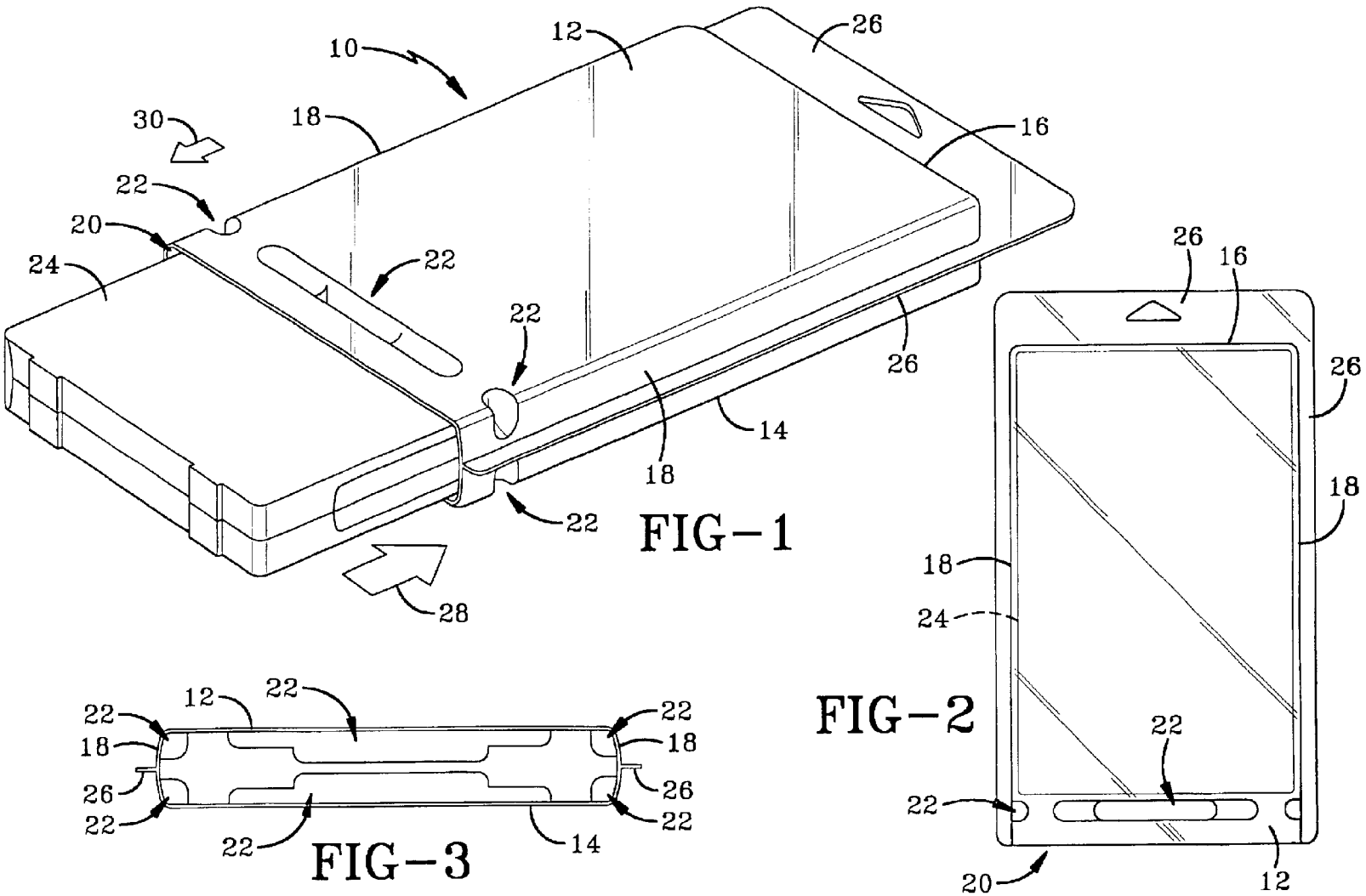
FIG. 1 is a perspective view of the first embodiment of the security storage package of the present invention with a DVD storage container being inserted into the security storage container.
FIG. 2 is a top view of the device of FIG. 1 with the DVD storage container loaded into the security storage container.
FIG. 3 is an end view of FIG. 2 showing the open bottom of the device.

The first embodiment of the security storage container of the present invention is generally indicated by the numeral 10 in FIGS. 1–3. Security storage container 10 is generally in the form of a five-sided box including a front wall 12, a rear wall 14, a top wall 16, and a pair of sidewalls 18. Security storage container 10 generally includes an open bottom as indicated by the numeral 20. Security storage container functions by including a plurality of protrusions 22 disposed adjacent open bottom 20 that allow a storage container 24 to be inserted into the storage compartment of security container 10 but not removed. Storage container 24 may only be removed from the storage compartment of security container 10 by cutting one or more of the walls or by otherwise destroying security storage container 10.

Security storage container 10 is preferably fabricated from a tough, resilient, substantially transparent plastic material that is difficult to break, cut, or tear. The thickness may vary depending on the application. For instance, a thickness between 0.01 and 0.03 inches is common but other thicknesses are also contemplated such as 0.06 inches. The material may be molded or vacuumed formed as is known in the art. The material has been used in packaging applications in the prior art. The art generally recognizes that this material is relatively strong and may be provided in thicknesses that are relatively difficult to cut even with a sharp blade. The thickness of the material may be varied depending on the level of security and the application for security container 10. For example, the material may be a thermoplastic such as a polypropylene or a polyethylene, injection molded plastics, vacuum formed plastics, vinyls, etc.

Security storage container 10 may be formed by providing a pair of identical halves that are each formed with connection flanges 26 extending along three sides of container 10. The halves are fit together to form a storage compartment and flanges 26 are permanently connected together to form container 10. Flanges 26 may be connected together by any of a variety of connection methods known in the art such as adhesives, welding, press fits, etc. In the preferred embodiment, flanges 26 are welded by welding.

In another embodiment of the invention, flanges 26 are not used and walls 18 are fit directly together in an end-to-end relationship. The walls of security storage container 10 may also be integrally fabricated in a one piece mold or forming process.

Protrusions 22 extend inwardly from the outer surface of security storage container 10 as shown in FIG. 3. Each protrusion 22 is designed to be flexible and accommodating in the insertion direction as indicated by the arrow labeled with numeral 28. Each protrusion 22 is configured to prevent removal of storage container 24 by not being flexible or yielding in the removal direction as indicated by the arrow labeled with the numeral 30. To achieve this function, each protrusion 22 may have a relatively flat surface facing the storage compartment with a relatively angled surface facing open bottom 20 of security storage container 10. Protrusions 22 generally include an upper and lower protrusion disposed at the lower edge of each sidewall 18 and an upper and lower protrusion disposed at the lower middle portion of front wall 12 and rear wall 14. Other arrangements of protrusions 22 are also contemplated by the present invention. As shown in FIG. 3, protrusions 22 block a substantial portion of the opening to the storage compartment and provide a substantial blocking wall to storage container 24 once storage container 24 is inserted into security container 10 as depicted in FIG. 2.

Figure 1A:
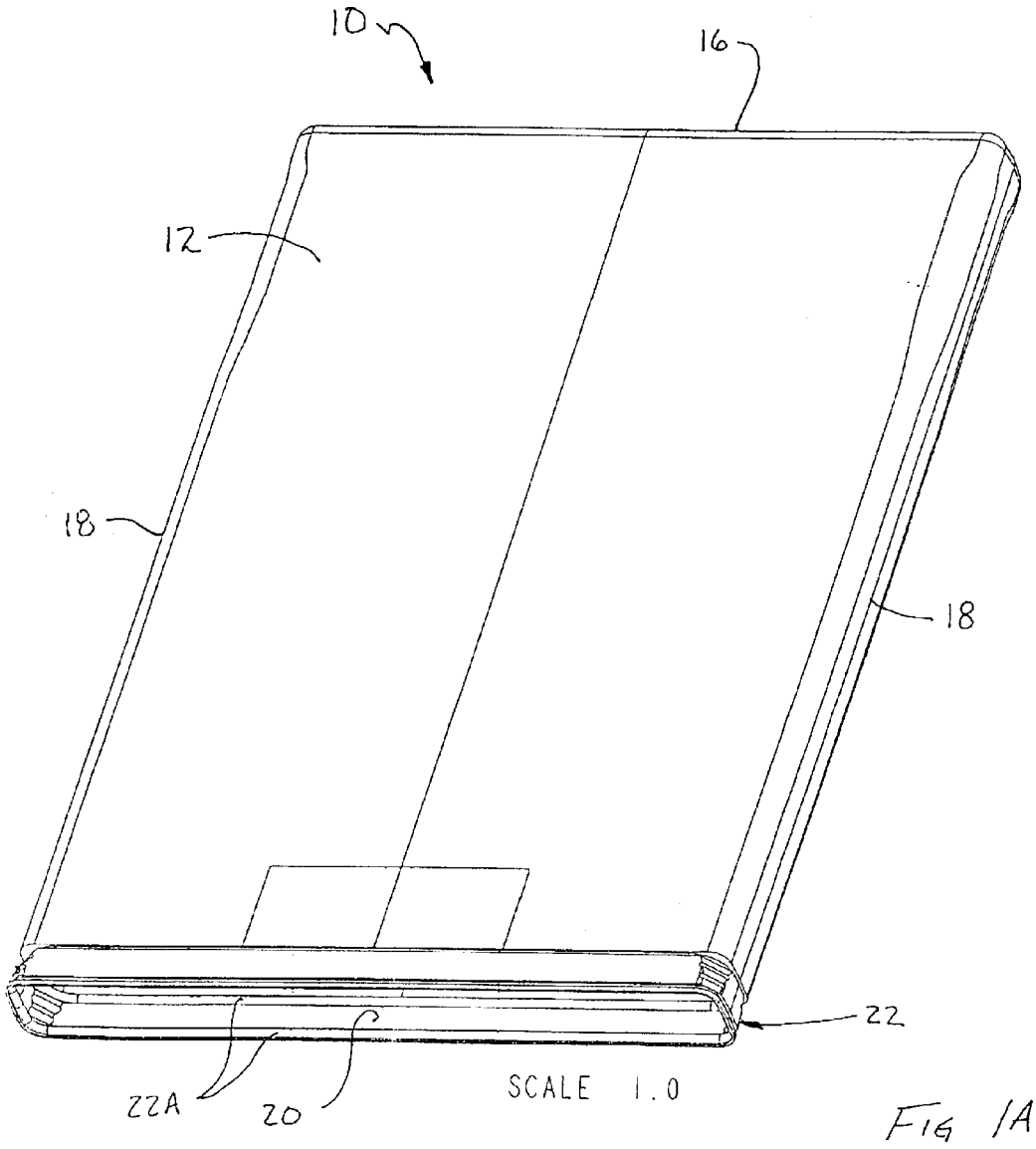
FIG. 1A is a perspective view of an alternative embodiment of the first embodiment of the security storage package of the present invention.

An alternative version of the first embodiment is depicted in FIG. 1A. In this embodiment, security storage container 10 is integrally fabricated in a single piece and lacks the flanges discussed above. Container 10 shown in FIG. 1A also includes a modified protrusion 22 structure that extends entirely around opening 20. Each corner includes ribbed protrusions 22 in addition to an inset protrusion 22 that extends entirely around opening 20. This protrusion structure has been found to securely hold storage containers having sharp corners as well as rounded corners. Protrusion 22 includes continuous lips 22A that are spaced apart and extend entirely around opening 20. In other embodiments, lips 22A may be discontinuous.

Figure 4:
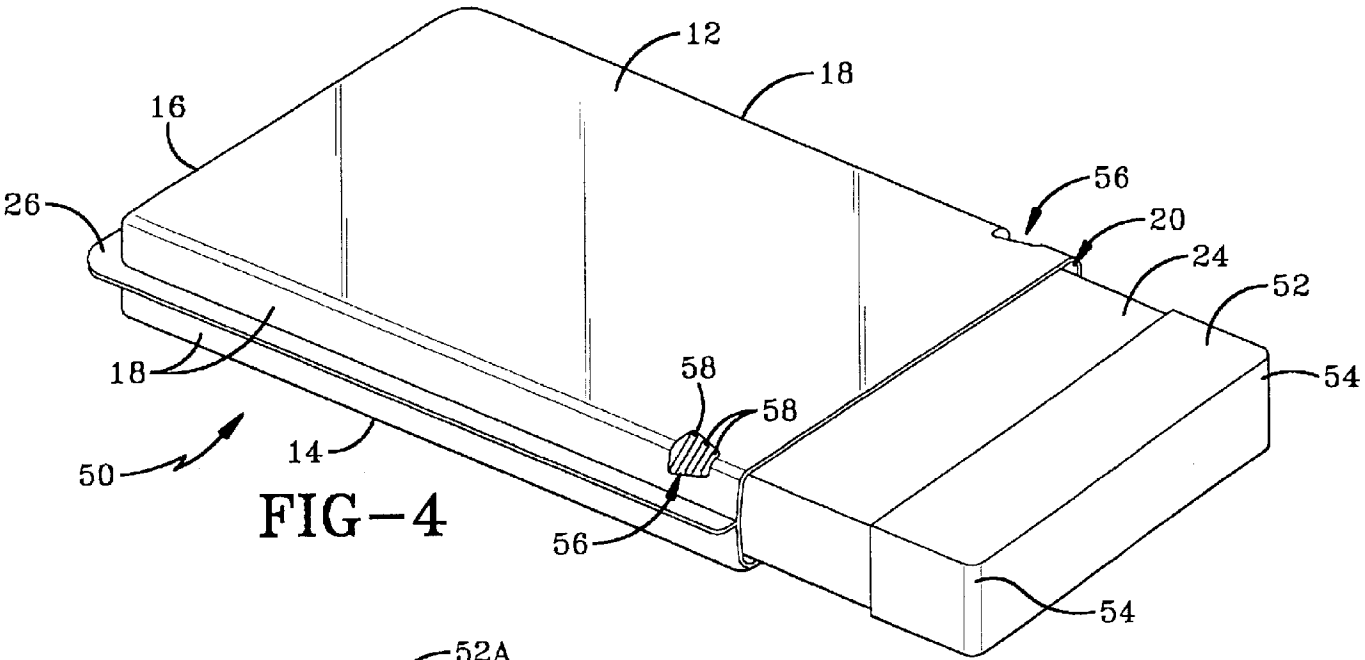
FIG. 4 is a perspective view of the second embodiment of the security storage container of the present invention being loaded with a DVD storage container.
Figure 5:
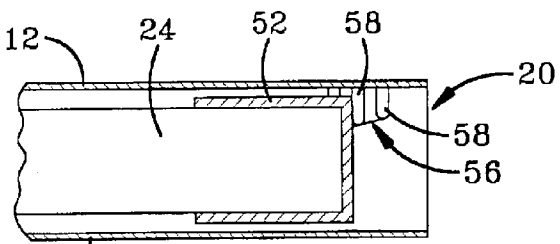
FIG. 5 is a sectional view of the second embodiment of the security storage container with the DVD storage container of FIG. 4 in the loaded position.

The second embodiment of the security storage container of the present invention is indicated generally by the numeral 50 in FIGS. 4 and 5. Security storage container 50 includes many of the same elements as security storage container 10 described above and the same numbers are used to refer to these elements. Security storage container 50 functions similar to security storage container 10 and may be fabricated from the same types of material as security storage container 10.

Some types of storage containers 24 have relatively rounded edges that will not allow protrusions 22 of first embodiment of security storage container 10 strongly secure storage container 24 inside of the storage compartment. Security storage container 50 provides an end cap 52 that includes corners 54 designed to cooperate with protrusions 56 to provide a secure holding arrangement. Protrusions 56 include a plurality of ribs 58 that extend into the storage compartment of security storage container 50. Protrusions 56 may be disposed at two corners as depicted in FIG. 4, all four corners, or in the arrangement depicted in FIG. 1 for protrusions 22. Protrusions 56 are configured to cooperate with corners 54 of end cap 52 to lock end cap 52 and thus storage container 24 inside of the storage compartment of security storage container 50 when end cap 52 is placed over storage container 24 and pressed up into security storage container 50 as shown in FIG. 5. End cap 52 thus allows security storage container 50 to be used with storage containers 24 having a configuration that prevents it from securely working with protrusions 22.

Figure 6:
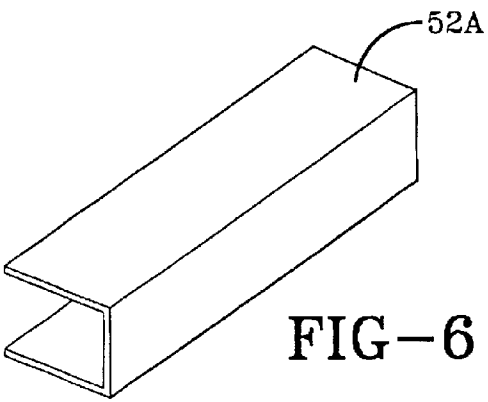
FIG. 6 is a perspective view of an alternative version of the end cap of the second embodiment of the present invention.
Figure 7:
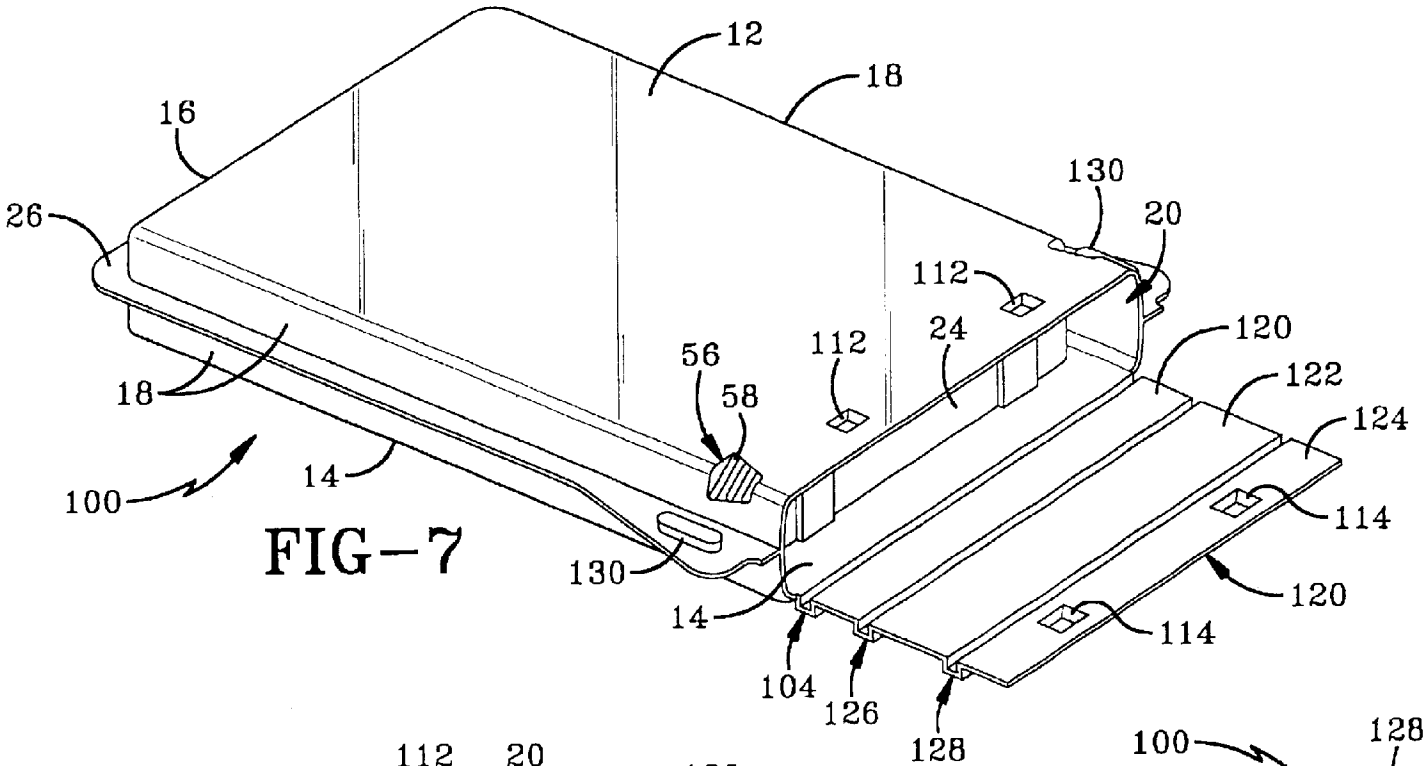
FIG. 7 is a perspective view of a third embodiment of the security storage container of the present invention with a DVD storage container loaded into the security container.

End cap 54 may be five-sided as depicted in FIG. 4 or three-sided as depicted in FIG. 6 and indicated with the numeral 52A.

Figure 9:
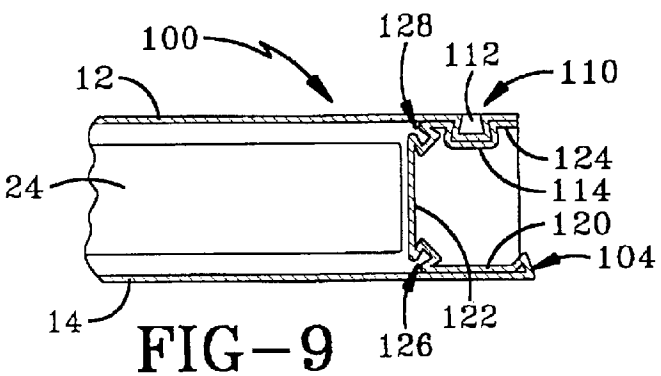
FIG. 9 is a view similar to FIG. 8 showing the end flap in a closed position.

The third embodiment of the security storage container of the present invention is indicated generally by the numeral 100 in FIGS. 7–17. Security storage container 100 includes many of the same elements as security storage container 10 and the same numbers are used to refer to those elements. Security storage container 100 includes an end flap 102 that is connected to rear wall 14 with a first hinge 104. First hinge 104 is preferably a living hinge including a pair of angled walls 106 and a spine 108. Hinge 104 may also have a rounded or folded cross section as is known in the art. End flap 102 is used to close open bottom 20 after storage container 24 is inserted into the storage compartment of security container 100. End flap 102 may be permanently locked in the closed position by appropriate welds or other connectors known in the art. In the embodiment of the invention depicted in the drawings, a pair of buttons 110 are provided on front wall 12 and end flap 102. Each button includes a male member 112 and a female member 114 that each have tapered sidewalls as shown in FIG. 9. The individual members of each button 110 snap together to connect the elements of button 110. Button 110 may be flattened to form a secure connection that may not be taken apart by flattening members 112 and 114 beyond the point where the material forming security container 100 will spring back. This causes male element 112 to be trapped within female element 114 thus locking end flap 102 over open bottom 20 of security container 100.

End flap 102 includes a first wall 120, a second wall 122, and a third wall 124. First wall 120 is connected to back wall 114 by first hinge 104. Second wall 122 is connected to first wall 120 by a second hinge 126 that has substantially the same structure of first hinge 104. Third wall 124 is connected to second wall 122 by a third hinge 128 that may also have the same structure as first hinge 104.

Figure 8:
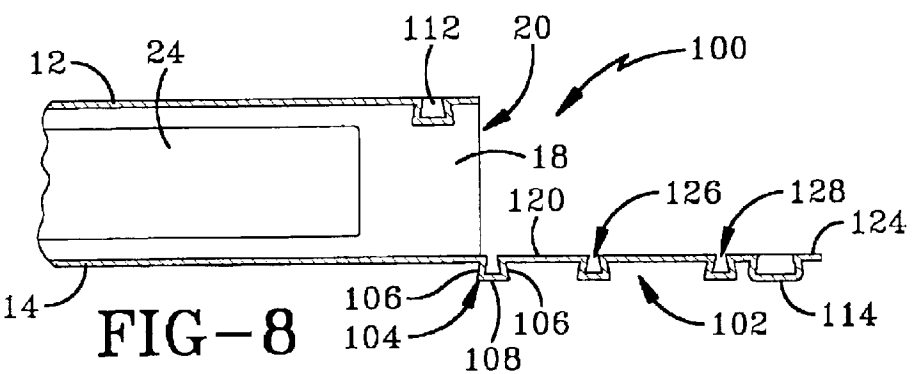
FIG. 8 is a sectional view of the bottom opening and end flap of the security storage container of FIG. 7 with the end flap in the open position.
Figure 10:
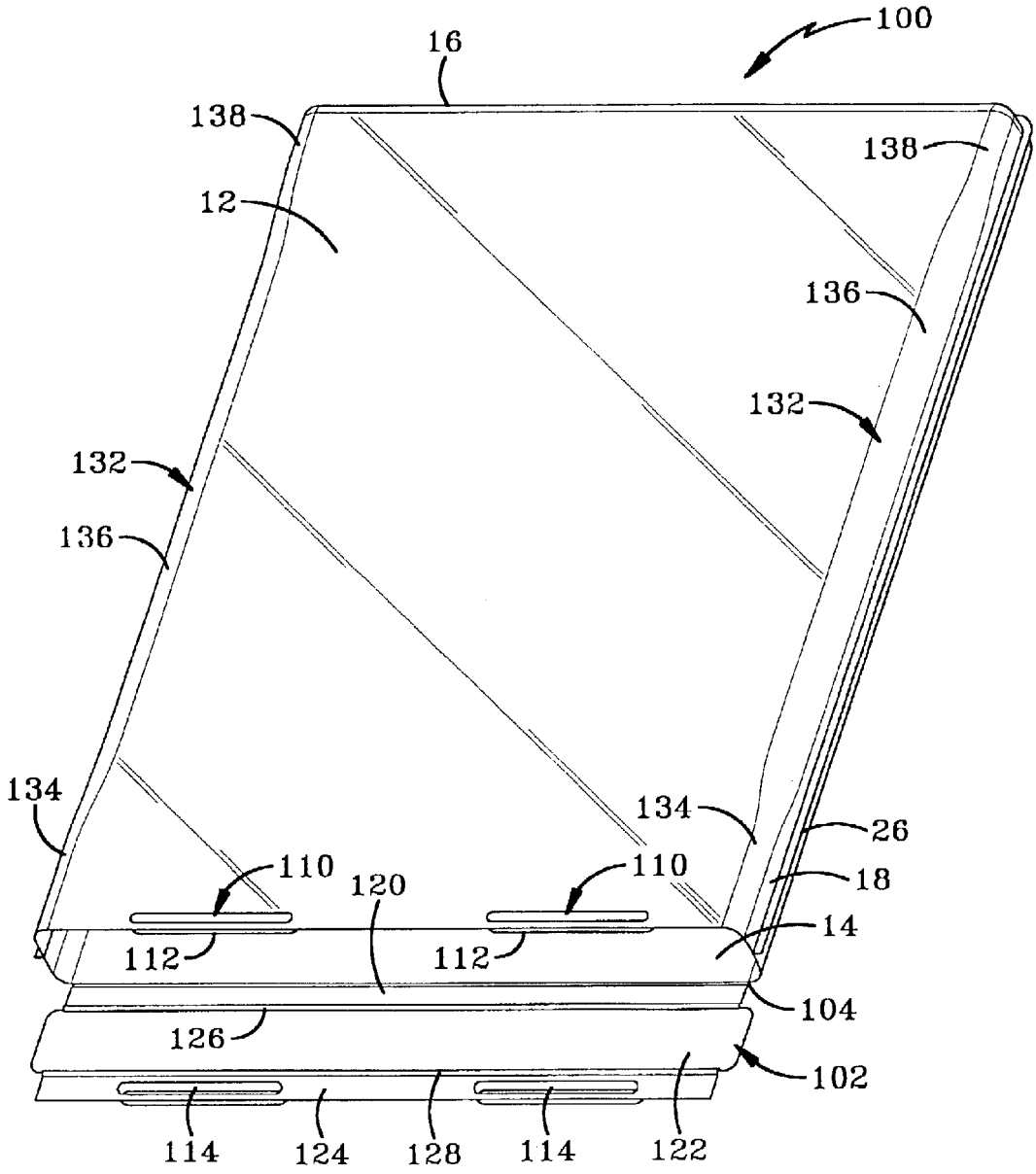
FIG. 10 is a perspective view of the security storage container of FIG. 7 showing the different radii on the corners of the device.
Figure 11:
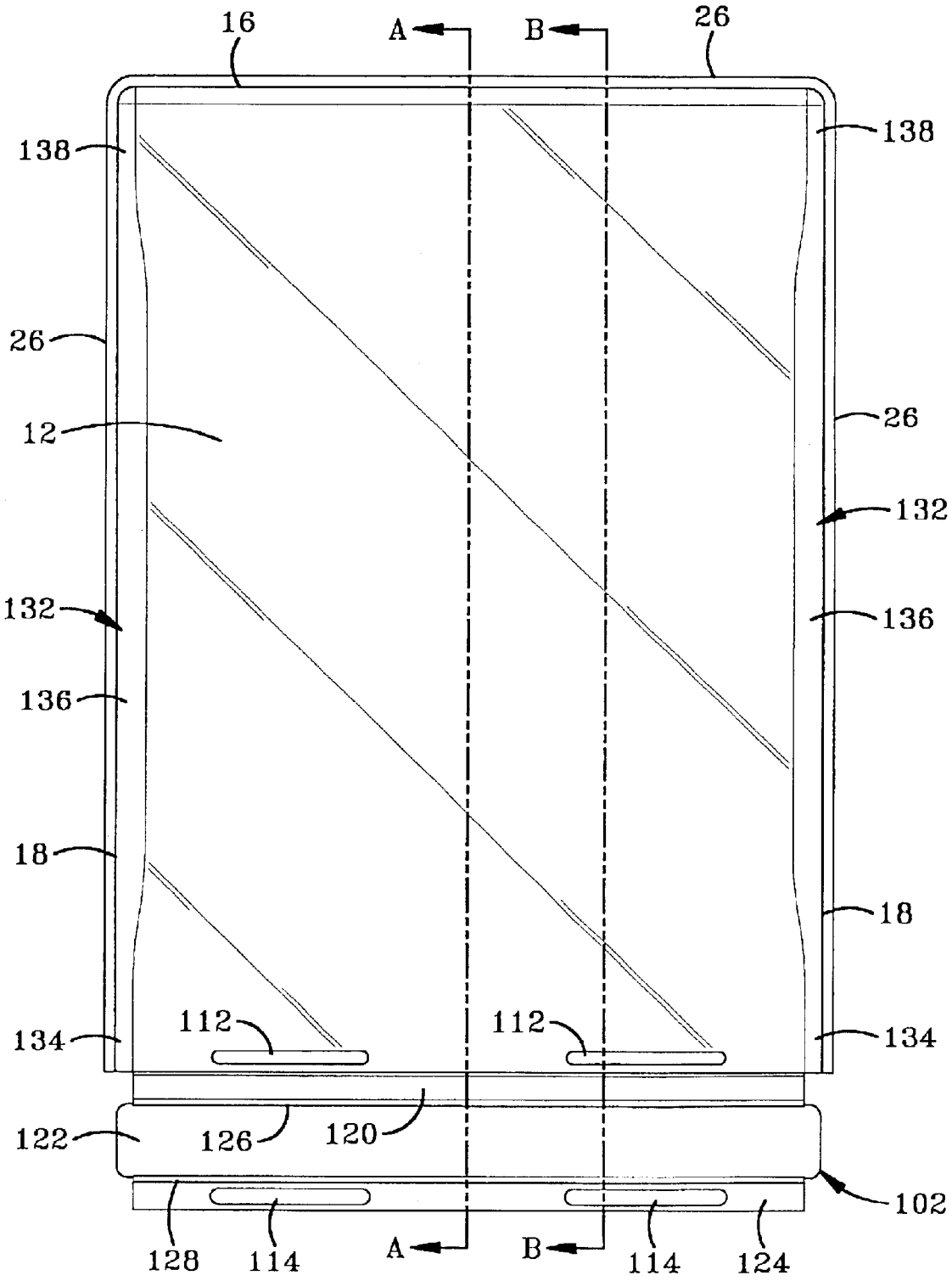
FIG. 11 is a front elevational view of FIG. 10.
Figure 12:
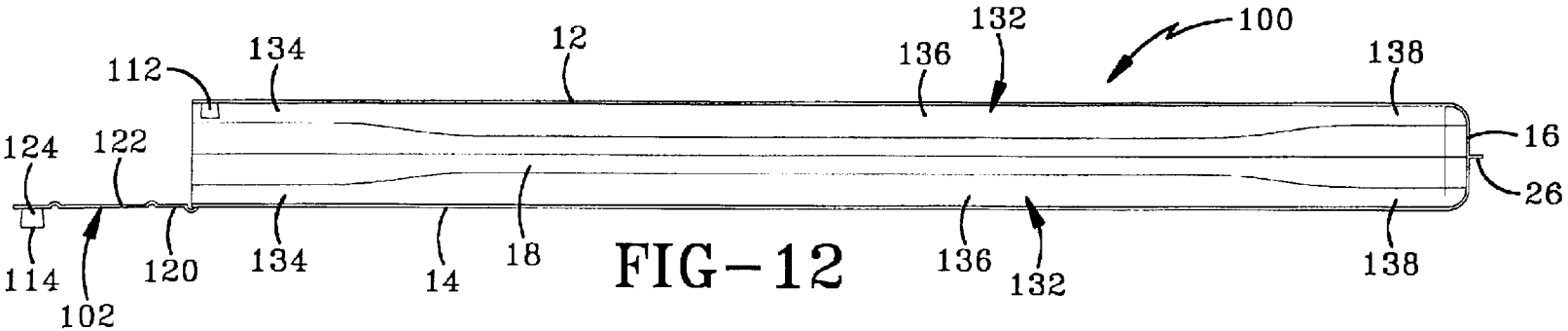
FIG. 12 is a sectional view taken along line A—A of FIG. 11.
Figure 13:
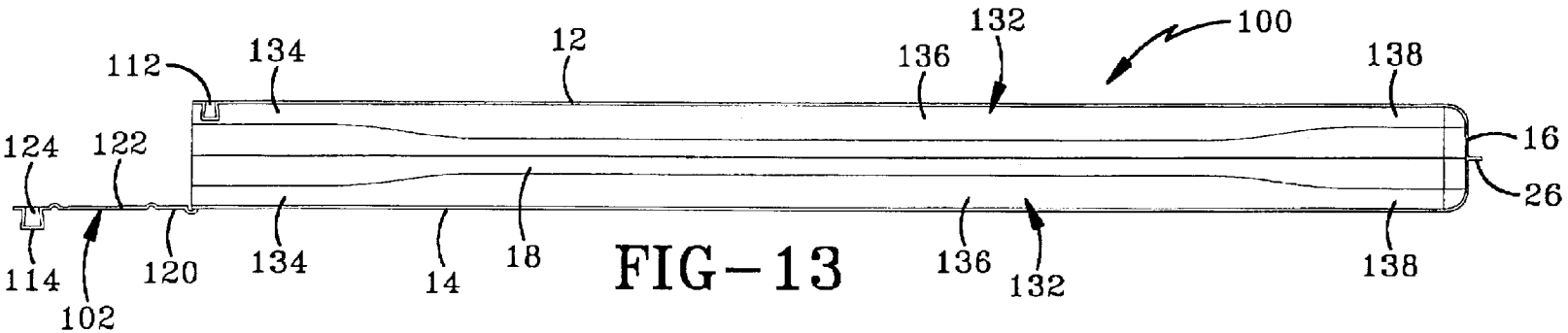
FIG. 13 is a sectional view taken along line B—B of FIG. 11.
Figure 14:
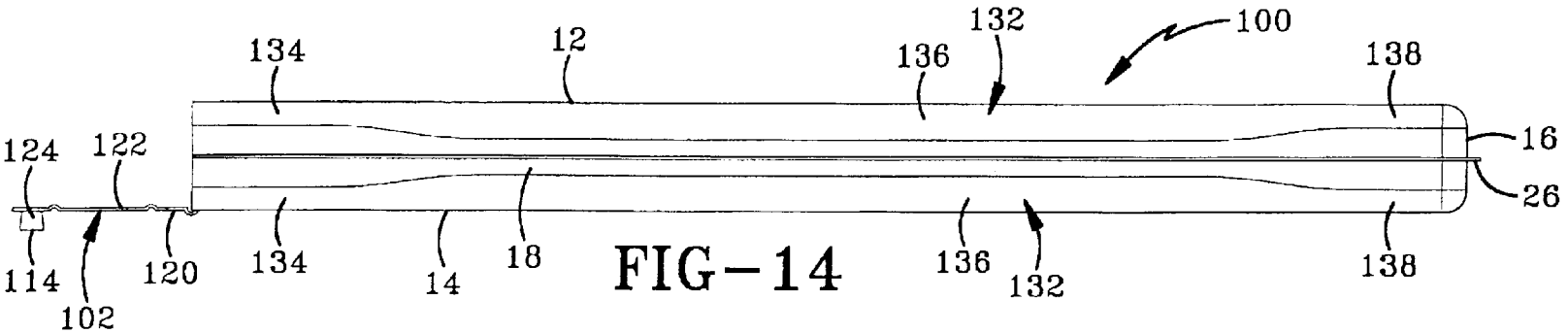
FIG. 14 is a side elevational view of FIG. 11.
Figure 15:
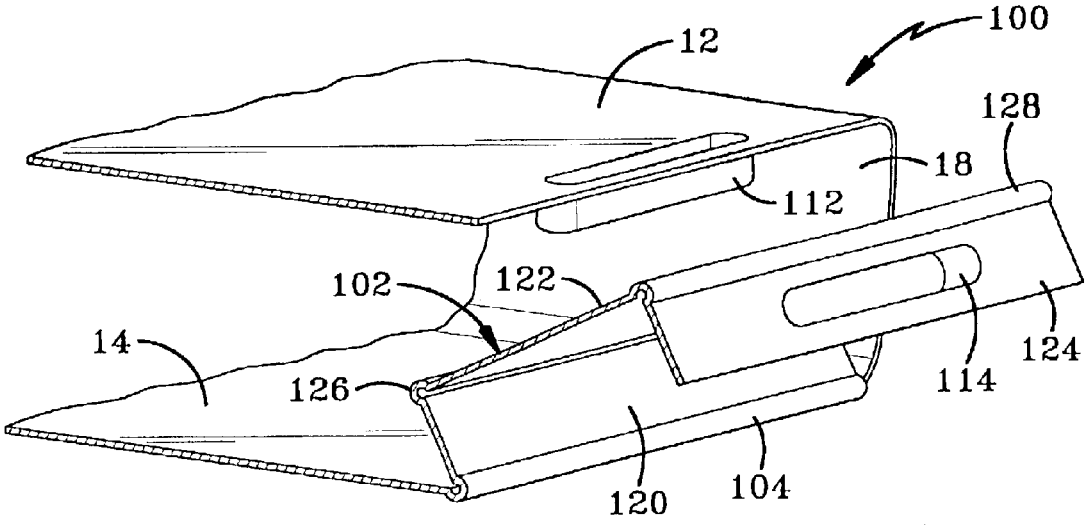
FIG. 15 is a perspective view of half of the end flap being closed.
Figure 16:
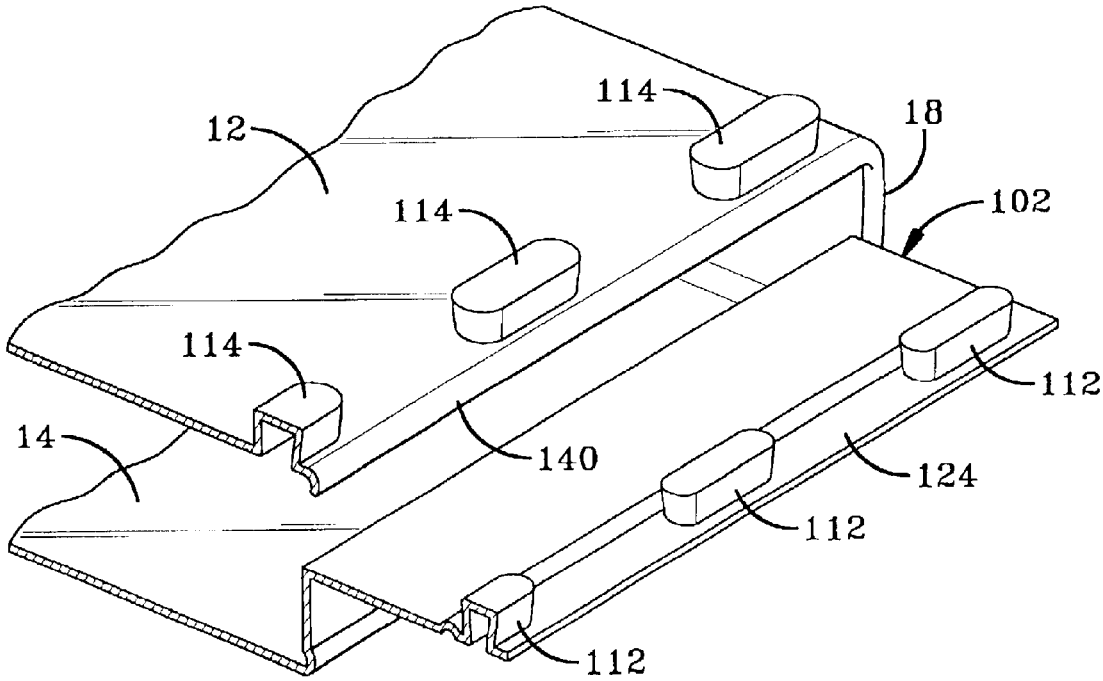
FIG. 16 is a perspective view similar to FIG. 15 showing an alternative version of the third embodiment of the present invention.

Female elements 114 are formed in third wall 124 such that they may be aligned with male elements 112 when end flap 102 is folded into the end of security container 100. The unfolded position is depicted in FIG. 8 while the folded position is depicted in FIG. 9. In the folded position, second wall 122 closes open bottom 20 of security container 10. While first wall 120 lies adjacent rear wall 14 and third wall 124 lies adjacent front wall 12. Second wall 122 is preferably sized to substantially close the entire opening of security container 10. Walls 120 and 124 have a width that allows them to move to the folded position while not interfering with the radius corners of security storage container 10.

Security storage container 100 may optionally include a pair of seal buttons 130 (FIG. 7) that function to provide an additional layer of security to security container 100. Security container 100 may additionally include protrusions 56 as described above.

Security storage container 100 includes four curved longitudinal corners 132. Each longitudinal corner includes a first section 134, a second section 136, and a third section 138. First and third sections 134 and 138 have a smaller radius of curvature than second section 136. Storage container 24 thus is provided with more clearance at sections 134 and 138 while frictionally engaging section 136. The frictional force between section 136 and storage container 24 prevents storage container 24 from rattling within security storage container 100 and prevents a potential shoplifter from easily pushing storage container 10 back against end flap 102.

In an alternative embodiment of the invention (see FIG. 16), male and female elements 112 and 114 are reversed such that male elements 112 are carried by end flap 102 while female elements 114 are carried by front wall 12.

In another alternative embodiment of the invention, buttons 110 are not used and a curved latch 140 (see FIG. 16) may be used to capture third wall 124 of end flap 102 to secure it in place. The connection may be permanently formed by appropriate welding, crimping, or gluing.

Figure 17:
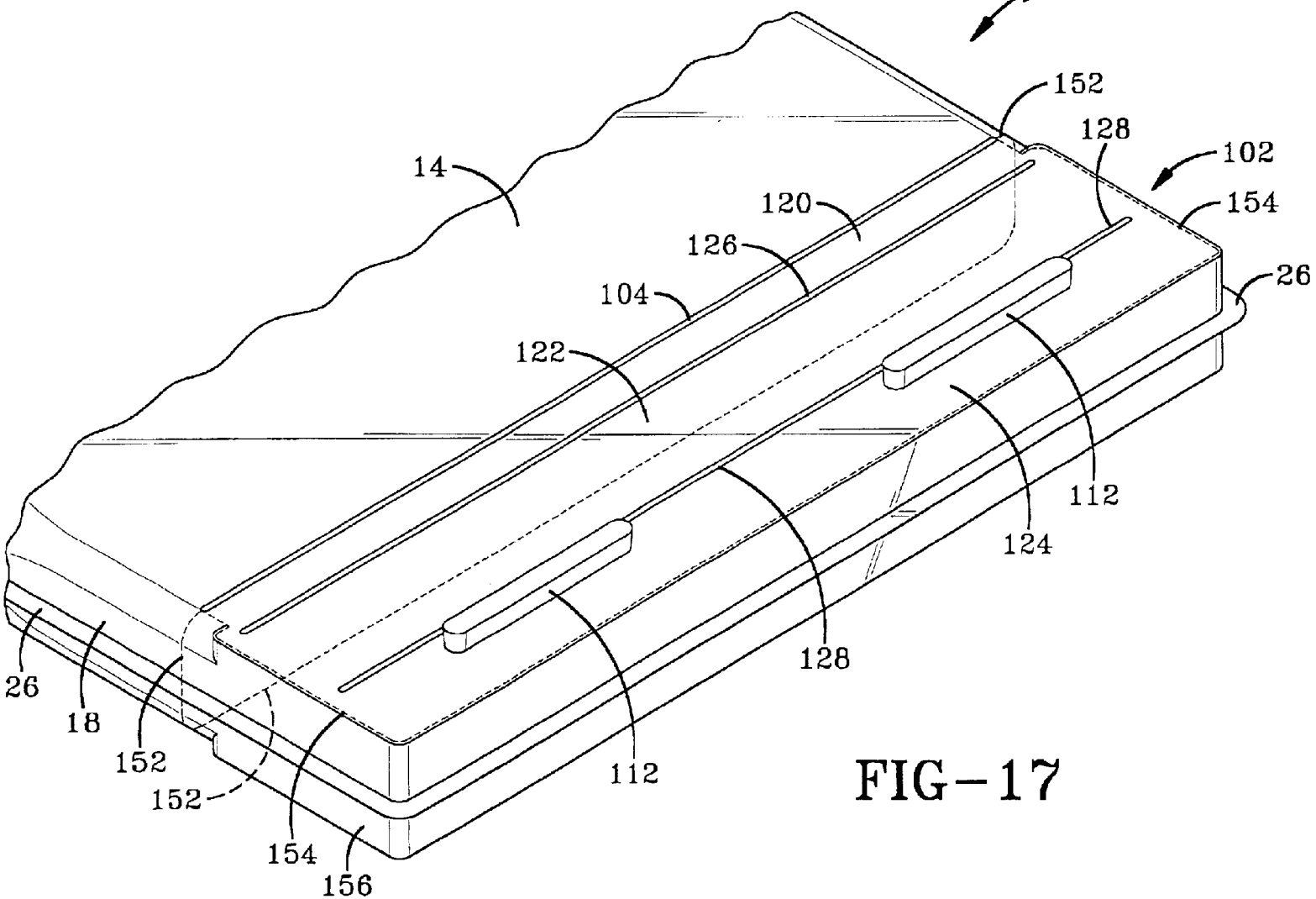
FIG. 17 is a view showing how the third embodiment of the present invention may be manufactured.
Figure 18:
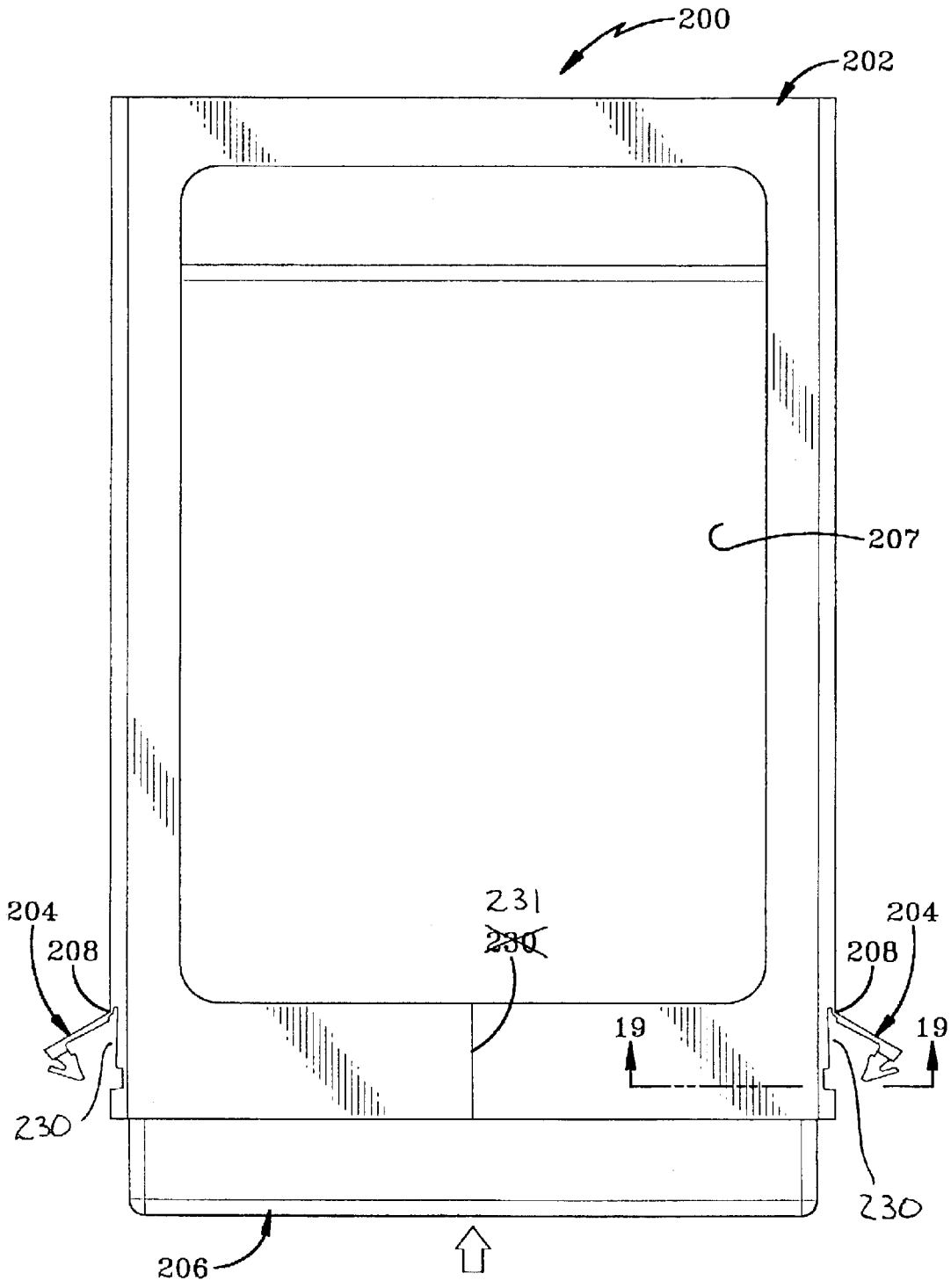
FIG. 18 is a front elevational view of a fourth embodiment of the present invention.

FIG. 17 depicts a method of manufacturing security storage container 100 wherein end flap 102 is formed as part of a closed container 150. Closed container 150 is cut along lines 152 and 154 to form security storage container 100 having end flap 102. The remainder 156 of container 150 that is not used is discarded and recycled. Forming security storage container 100 in this manner achieves one of the objectives of the present invention.

The fourth embodiment of the security sleeve of the present invention is indicated generally by the numeral 200 in FIGS. 18–22. Security sleeve 200 generally includes a frame 202 and a pair of locking members 204. Locking members 204 are each movable between unlocked and locked positions to lock an item of recorded media 206 within frame 202 until frame 202 is at least partially destroyed. Item of recorded media 206 typically includes a housing or a storage container. Essentially any type of recorded media may be used with sleeve 200. For instance, item 206 may be a tape, a disc, or a game cartridge. In other applications, sleeve 200 may be used with other items of merchandise such as boxed items or books.

Frame 202 is in the form of a five-sided box having an insertion opening at its open side so that item 206 may be slid into the storage chamber inside frame 202. Frame 202 is sized to slidingly receive item 206. Item 206 may be frictionally received in frame 202 or may be loosely received in frame 202. In the drawings, item 206 is disposed loosely within frame 202 but it is understood that the outer surfaces of item 206 may frictionally engage the inner surfaces of frame 202.

Frame 202 may include a plurality of openings 207 that allow the consumer to directly view the graphics and text on item 206 without looking through frame 202. Frame 202 has one dimension that is greater than the corresponding dimension of item 206. The example depicted in FIGS. 18–22, the longitudinal length of frame 202 is longer than the longitudinal length of item of recorded media 206. The dimension discrepancy provides room for locking members 204 to lock against a wall of item 206.

In the fourth embodiment, locking members 204 are positioned near the end of frame 202 where item 206 is loaded. Each locking member 204 is hingedly connected to frame 202 with a hinge 208. Hinge 208 may be a living hinge that is integrally formed with frame 202. Hinge 208 may also be a separately-formed hinge that is attached to frame 202 after it is formed. Hinge 208 allows locking member 204 to pivot between the unlocked position shown in FIG. 21 and the locked position shown in FIG. 22.

In the fourth embodiment of the invention, locking members 204 each include an arm 210 and a protrusion 212. Arm 210 is connected to frame 202 by hinge 208. Protrusion 212 includes at least one locking finger 214 that locks member 204 in the locked position by engaging frame 202. Locking finger 214 is angled from the inner end of protrusion 212 outwardly towards the plane of arm 210 but downwardly away from arm 210 and hinge 208. Finger 214 is flexible enough to be moved inwardly toward protrusion 212 when locking member 204 is being inserted into frame 202. Locking member 204 further includes a second locking finger 216 disposed on the upper side of protrusion 212.

Frame 202 defines an opening 220 adjacent each locking member 204. Each opening 220 is positioned below the lower edge 222 of item 206 when item 206 is fully inserted into frame 202. Opening 220 is sized to receive protrusion 212 when at least one locking finger 214 is depressed. Frame 202 includes first 224 and second 226 locking ledges disposed above and below opening 220.

Figure 22:
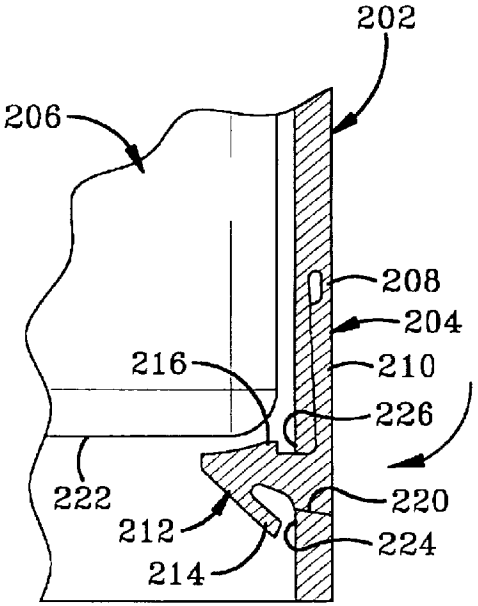
FIG. 22 is a view similar to FIG. 21 showing the locking member in the locked position.
Figure 21:
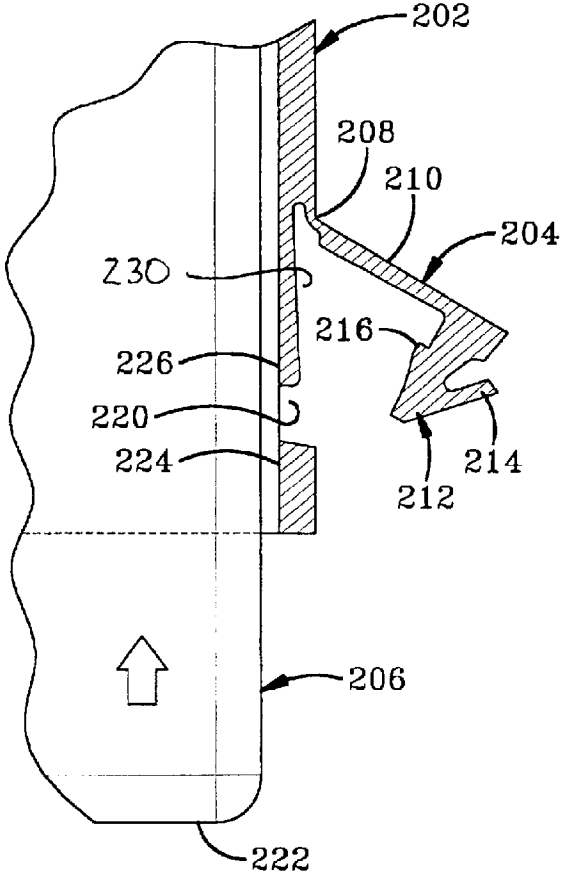
FIG. 21 is an enlarged view, partially in section, of the locking member in the unlocked position.
Figure 19:
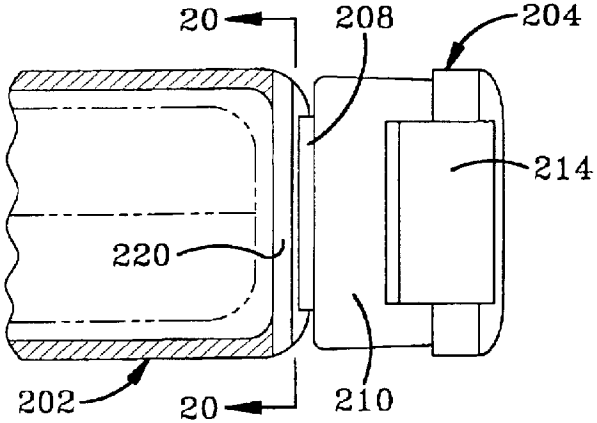
FIG. 19 is a sectional view taken along line 19—19 of FIG. 18.
Figure 20:
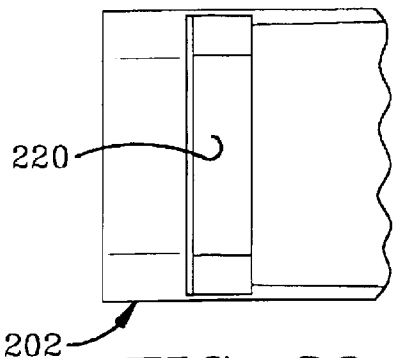
FIG. 20 is a view taken along line 20—20 of FIG. 19.

Frame 202 also defines a channel 230 between each hinge 208 and each opening 220. Channel 230 is sized to receive arm 210 when locking member 204 is in the locked position so that the outer surface of arm 210 is flush with the outer surface of frame 202 as shown in FIG. 22.

Security sleeve 200 functions by receiving item of recorded media 206 through the opening until item of recorded media 206 is fully inserted into frame 202. Item of recorded media 206 is preferably stored in some type of storage container as is known in the art. Lower edge 222 of the storage container of item of recorded media 206 is positioned adjacent openings 220 when item 206 is fully inserted. Both locking members 204 are then moved from the unlocked position to the locked position. When moving from the unlocked to locked position, locking finger 214 is depressed by engaging frame 202 and snaps through opening 220. Protrusion 212 is preferably configured so that locking finger 214 must be pushed through opening 220 with force. In the embodiment depicted in the drawings, finger 214 flexes frame 202 when being pushed through opening 220. Once protrusion 212 is in the locked position, locking finger 214 springs outwardly to engage ledge 224 to prevent locking member 204 from returning to the unlocked position. Locking finger 214 is configured to prevent a shoplifter from reaching inside frame 202 and pushing upwardly on locking finger 214 and withdrawing locking member 204 from opening 220. If a shoplifter pushes upwardly on locking finger 214 and protrusion 212, second locking finger 216 engages ledge 226 to prevent locking member 204 from being withdrawn from opening 220. When locking members 204 are in the locked position, item 206 cannot be removed from frame 202 and the user must cut or otherwise destroy a portion of frame 202 before removing item 206. For example, the user may cut frame 202 along cut line 231 on both sides of frame 202. Once cut in these areas, frame 202 may be forced open and item 206 may be removed.

Severing hinge 208 does not allow locking member 204 to be withdrawn from opening 220. Locking member 204 is configured such that it cannot be pushed through opening 220 if hinge 208 is severed. The lower surfaces of opening 220 and protrusion 212 are angled to wedge protrusion 212 in opening 220 if hinge 208 is severed and protrusion 212 is pushed inwardly.

Figure 24:
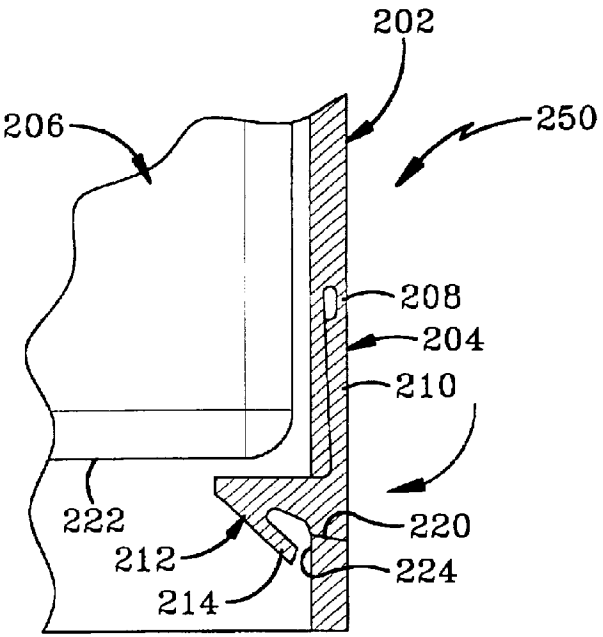
FIG. 24 is a view of the fifth embodiment in the locked position.
Figure 23:
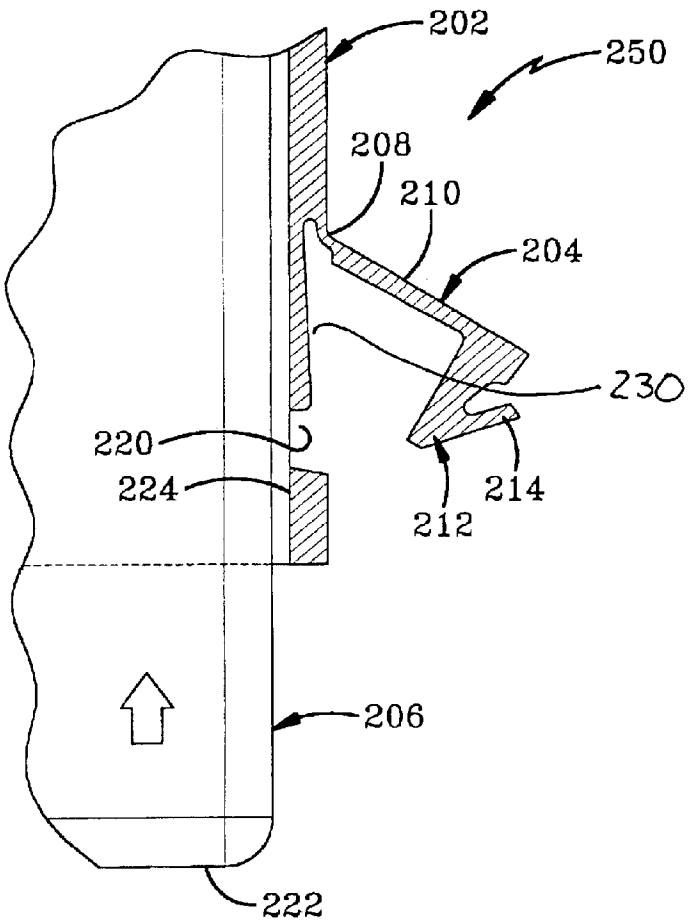
FIG. 23 is a view similar to FIG. 21 showing a fifth embodiment of the invention.

The fifth embodiment of the security sleeve is depicted in FIGS. 23 and 24 and is indicated generally by the numeral 250. Security sleeve 250 includes many of the same elements as security sleeve 200 and the same numbers are used to refer to these elements. Sleeve 250 differs from sleeve 200 because protrusion 212 includes only first locking finger 214 and does not have a second locking finger on its upper edge. The removal of the second locking finger allows protrusion 212 to be inserted into frame 202 easier because protrusion 212 presents less resistence.

Figure 26:
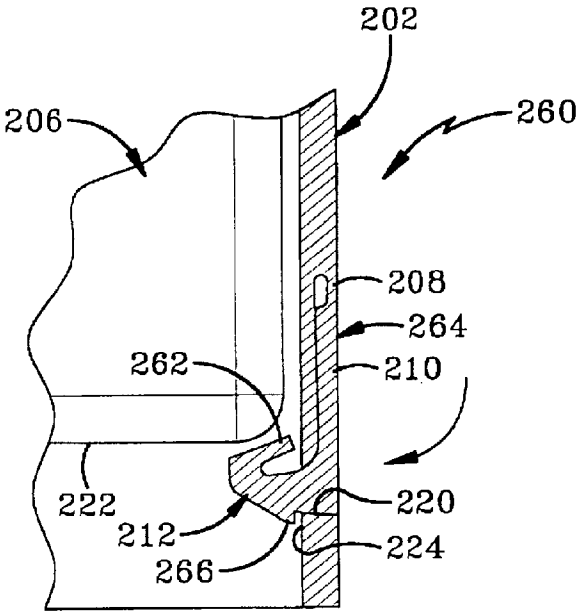
FIG. 26 is a view of the sixth embodiment in the locked position.
Figure 25:
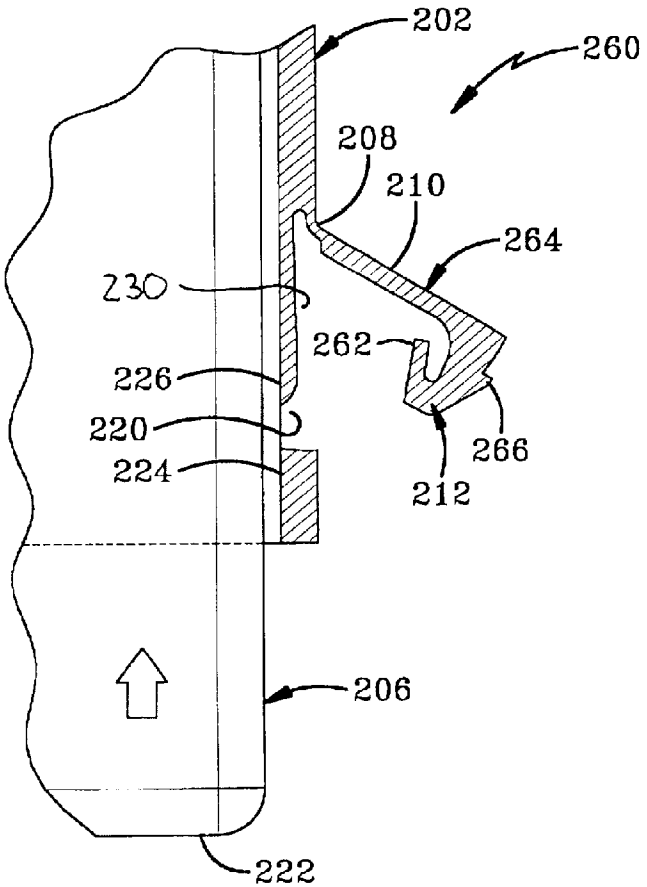
FIG. 25 is a view similar to FIG. 21 showing the sixth embodiment of the invention in the unlocked position.

The sixth embodiment of the security sleeve of the invention is indicated generally by the numeral 260 in FIGS. 25 and 26. Security sleeve 260 includes many of the same elements as security sleeve 200 and the same numbers are used to refer to these elements. In this embodiment, protrusion 212 includes a first locking finger 262 that extends upwardly and rearwardly from the inner end of protrusion 212. Locking finger 262 is flexible so that it may be depressed when locking member 264 is pushed through opening 220. Protrusion 212 includes a second locking finger 266 extending downwardly from protrusion 212. In this embodiment, second locking finger 266 is smaller and less flexible than finger 262. Locking fingers 262 and 266 engage ledges 224 and 226 when locking member 264 is in the locked position to prevent locking member 264 from being moved back to the unlocked position.

Figure 61:
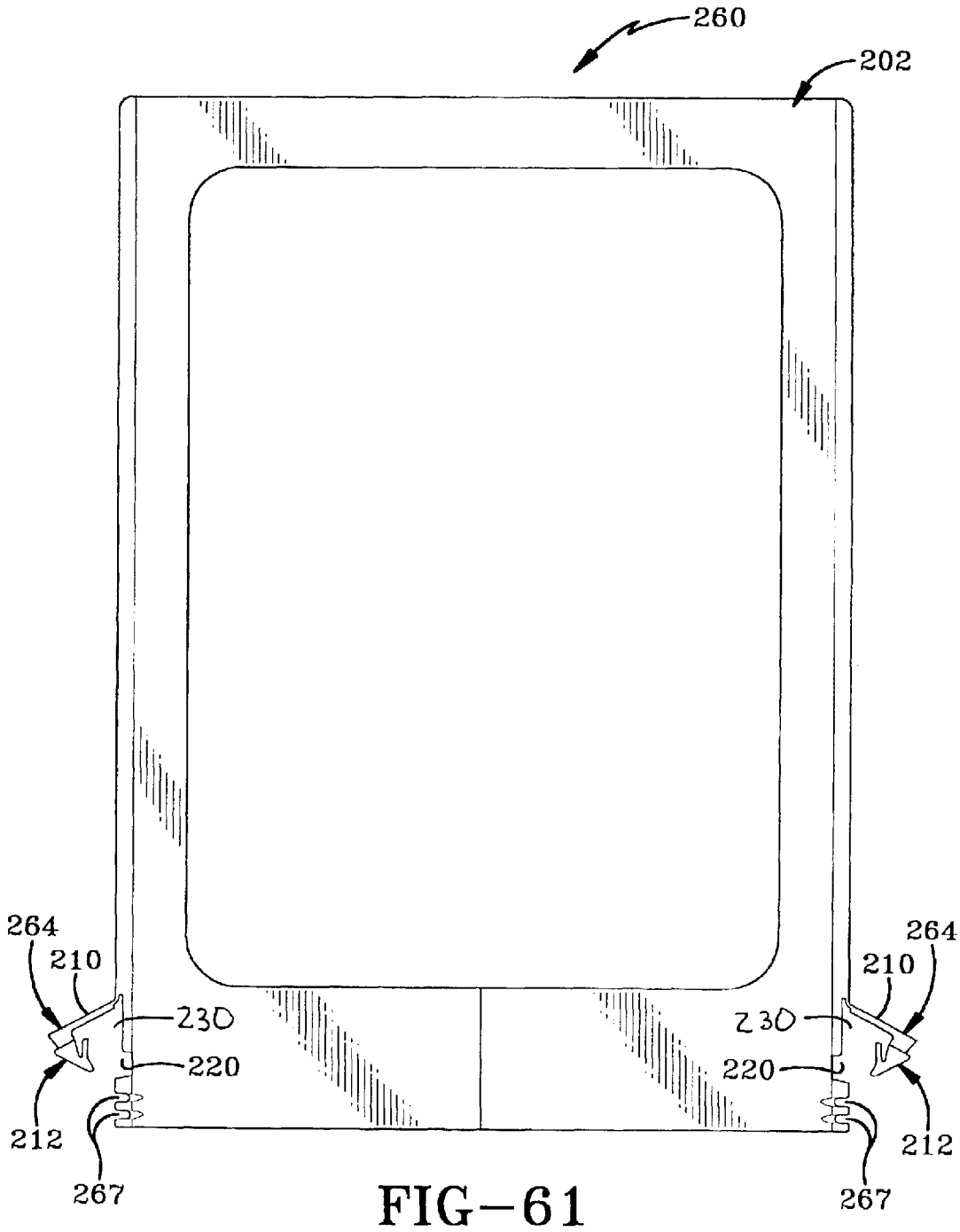
FIG. 61 is a front view showing a shock absorbing structure.
Figure 62:
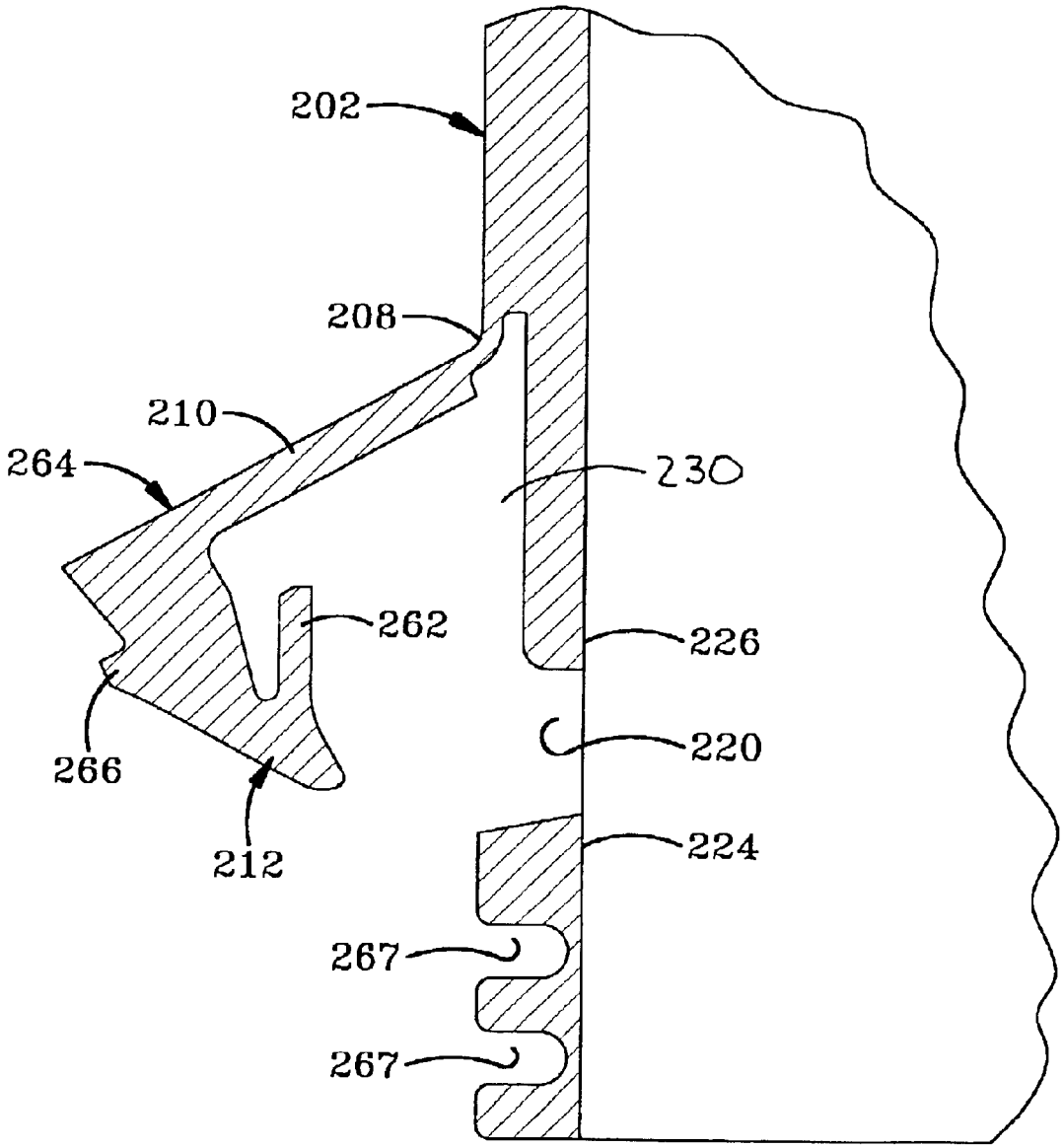
FIG. 62 is a section view of the shock absorbing structure.

FIGS. 61 and 62 depict an alternative embodiment of frame 202 that may be applied to any of the relevant embodiments disclosed in this application. Frame 202 shown in FIGS. 61 and 62 includes at least one shock absorbing notch 267 that allows the lower corners of frame 202 to crumple if a shoplifter slaps frame 202 against a hard surface in an attempt to break the corner of frame 202 or locking member 264. Each notch 267 may extend around to the front and back of frame 202 as depicted in FIG. 61. Each notch may extend substantially through the sidewalls of frame 202 as depicted in FIG. 62 but shallower notches may also be used.

Figure 28:
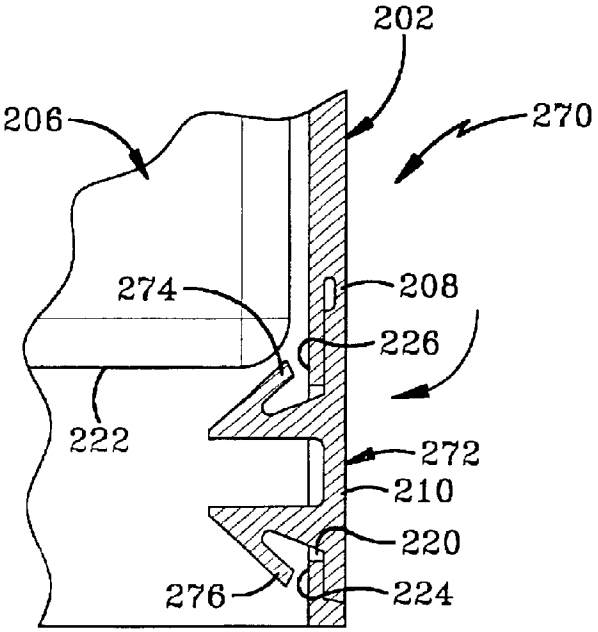
FIG. 28 is a view of the seventh embodiment in the locked position.
Figure 27:
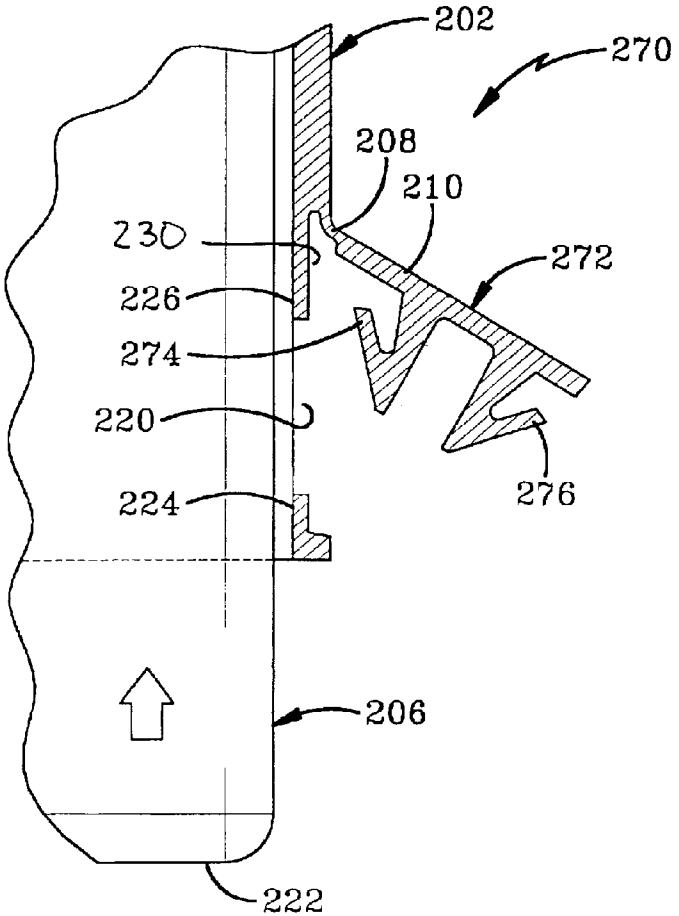
FIG. 27 is a view similar to FIG. 21 showing the seventh embodiment of the invention.

The seventh embodiment of the invention is depicted in FIGS. 27 and 28 and is indicated generally by the numeral 270. Security sleeve 270 includes many of the same elements as sleeve 200 and the same numbers are used to refer to these elements. The locking members 272 of security sleeve 270 include first and second 274 and 276 resilient locking fingers that each flex when locking member 272 is pushed through opening 220.

Locking fingers 274 and 276 are independent of one another and extend from arm 210 at spaced apart locations. The protrusion of locking member 272 thus includes both locking fingers 274 and 276.

Figure 30:
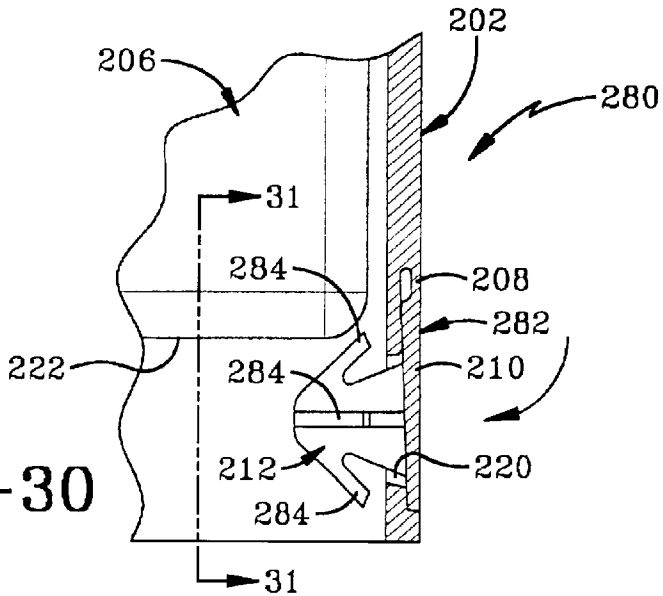
FIG. 30 is a view of the eighth embodiment in the locked position.
Figure 31:
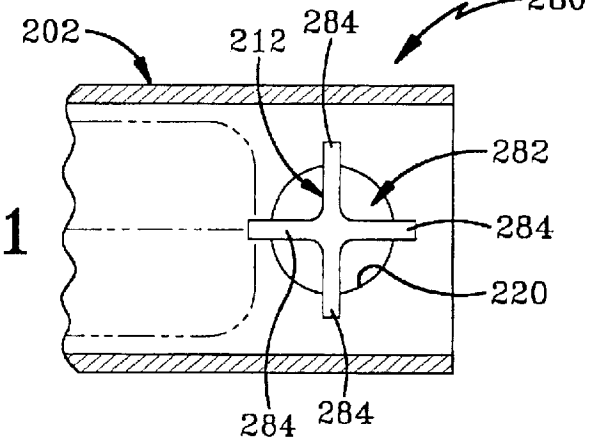
FIG. 31 is a sectional side view of the eighth embodiment taken along line 31—31 of FIG. 30.
Figure 29:
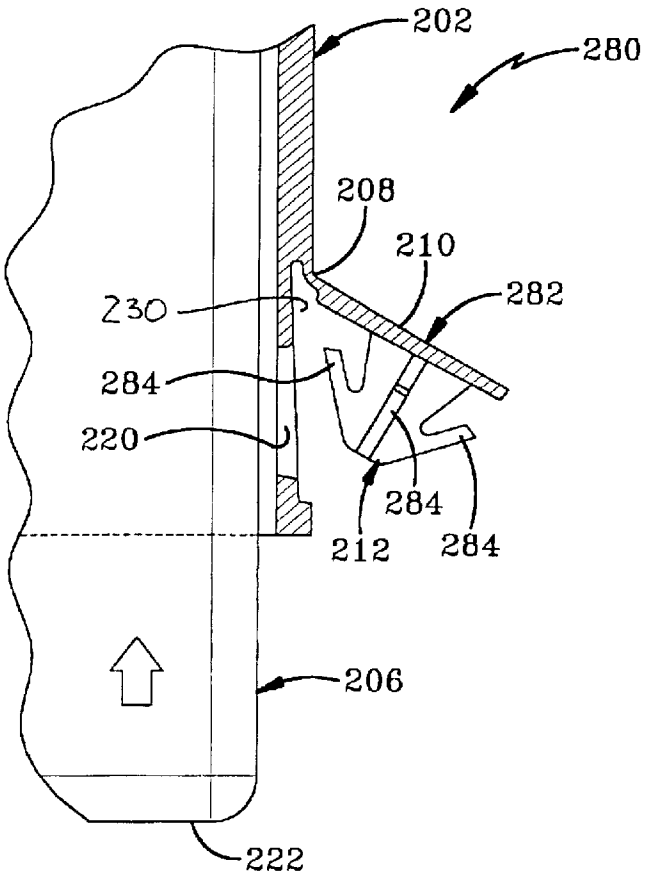
FIG. 29 is a view similar to FIG. 21 showing the eighth embodiment of the invention.

The eighth embodiment of the security sleeve is indicated generally by the numeral 280 in FIGS. 29–31. In this embodiment, locking members 282 include four locking fingers 284 that are each disposed substantially perpendicular to one another. Each finger 284 is configured to fit through opening 220 when locking member 282 is moved from the unlocked position to the locked position. In an alternative configuration of this embodiment, three locking fingers 284 extend from protrusion 212. The angle between fingers 284 may be varied without departing from the concepts of the invention.

Figure 33:
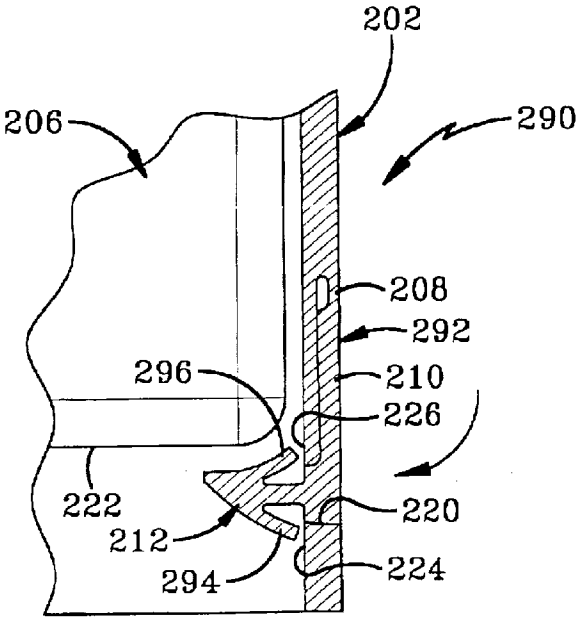
FIG. 33 is a view of the ninth embodiment in the locked position.
Figure 32:
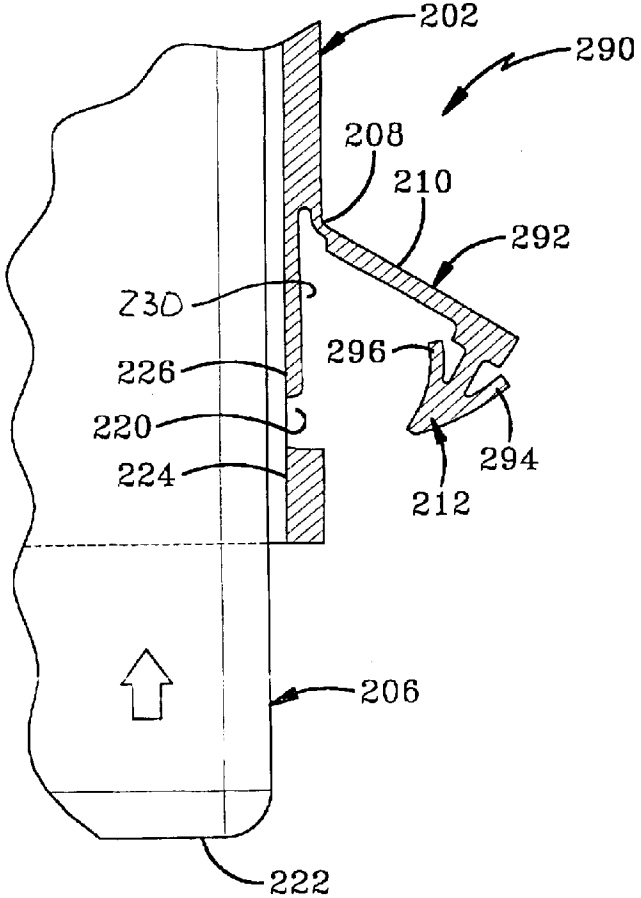
FIG. 32 is a view similar to FIG. 21 showing the ninth embodiment of the invention.

The ninth embodiment of the invention is indicated generally by the numeral 290 in FIGS. 32 and 33. In this embodiment, each locking member 292 includes first and second locking fingers 294 and 296 that each extend rearwardly and outwardly from the end of protrusion 212. Locking fingers 294 and 296 are designed to flex as locking member 292 is inserted through opening 220. Locking finger 294 engages ledge 224 and locking finger 296 engages ledge 226 when locking member 292 is in the locked position.

Figure 34:
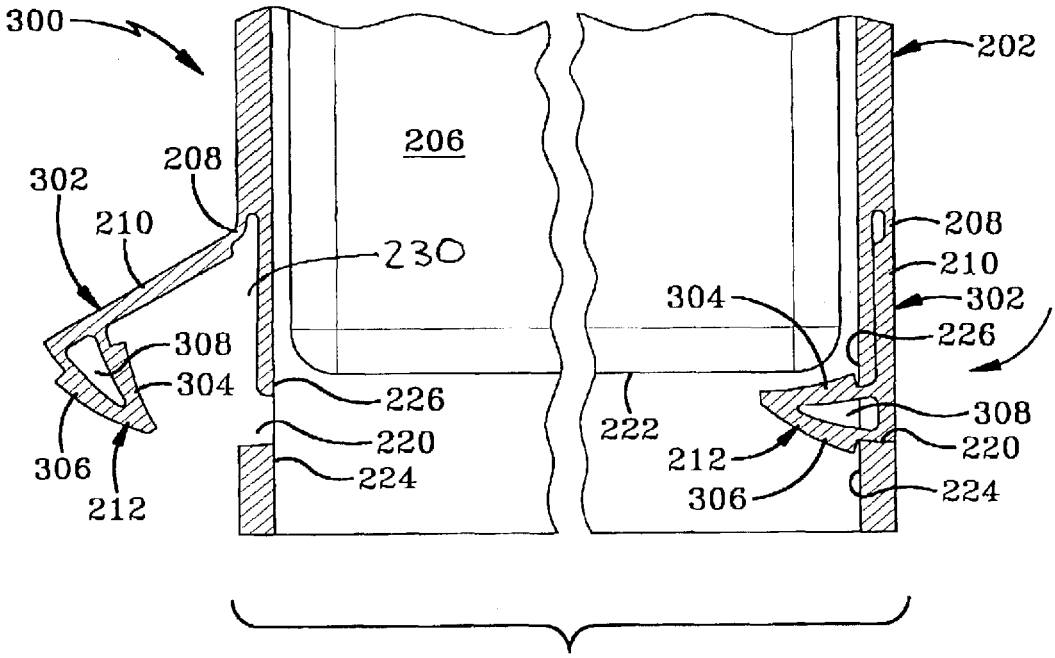
FIG. 34 is a front sectional view of the tenth embodiment of the invention with one side locked and one side unlocked.

Turning now to FIG. 34, the tenth embodiment of the security sleeve of the invention is indicated by the numeral 300. Security sleeve 300 includes many of the same elements as sleeve 200 and the same numbers are used to refer to these elements. The locking members 302 of security sleeve 300 include first 304 and second 306 resilient locking fingers that each flex when locking member 302 is pushed through opening 220. In this embodiment, fingers 304 and 306 are connected together at their inner ends and are connected to arm 210 at their outer ends. An opening 308 is defined by arms 304 and 306. Opening 308 allows arms 304 and 306 to flex towards each other when protrusion 212 of locking member 302 is forced through opening 220.

Figure 35:
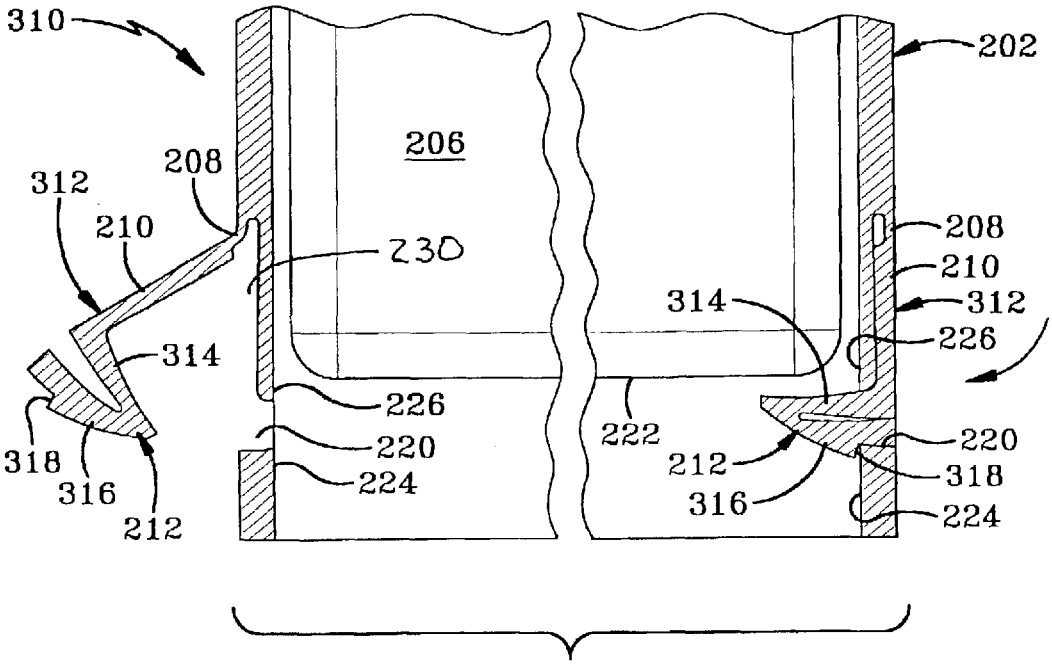
FIG. 35 is a front sectional view of the eleventh embodiment of the invention with one side locked and one side unlocked.

The eleventh embodiment of the invention is depicted in FIG. 35 and is indicated generally by the numeral 310. Security sleeve 310 includes many of the same elements as sleeve 200 and the same numbers are used to refer to these elements. The locking members 312 of security sleeve 310 include first 314 and second 316 resilient locking fingers that each flex when locking member 312 is pushed through opening 320. In this embodiment, first locking finger 314 is connected to arm 210 at its outer end. The inner end of first locking finger 314 is connected to the inner end of second locking finger 316. The outer end of second locking finger 316 is cantilevered. Second locking finger 316 includes a ledge 318 that latches against ledge 224 when locking member 312 is in the locked position.

Figure 36:
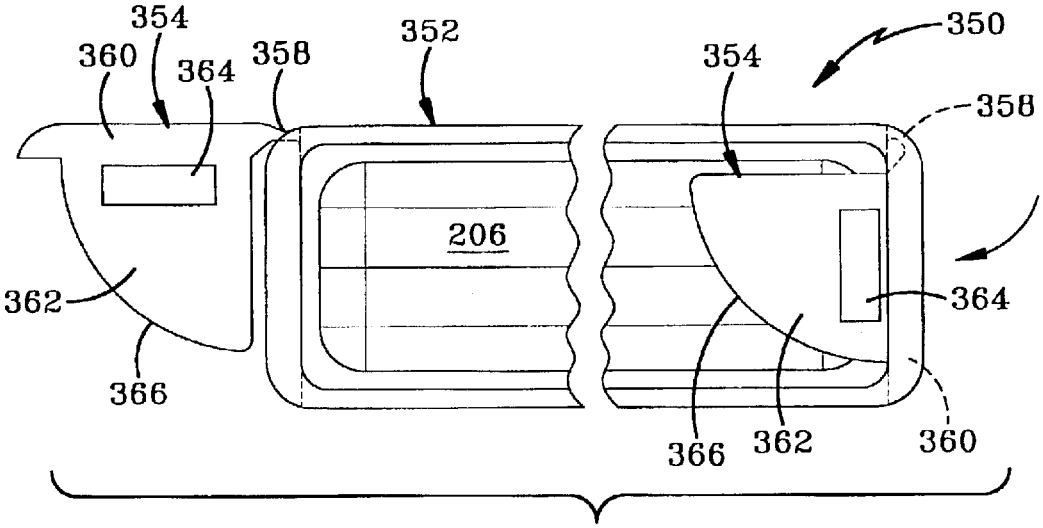
FIG. 36 is a bottom plan view of the twelfth embodiment of the invention with one side locked and one side unlocked.

The twelfth embodiment of the invention is depicted in FIG. 36 and is indicated generally by the numeral 350. Security sleeve 350 generally includes a frame 352 similar to frame 202 described above. Security sleeve 350 further includes a pair of locking members 354. Each locking member 354 is movable between an unlocked position (the left side of FIG. 36) and a locked position (the right side of FIG. 36) to lock an item of recorded media 206 within frame 352 until frame 352 is at least partially destroyed.

Frame 352 is configured to surround five sides of item 206. Frame 352 includes an insertion opening so that item 206 may be slid into the storage chamber defined by frame 352. Each locking member 354 is positioned near the end of frame 352 where item 206 is inserted into the storage chamber of frame 352. Each locking member 354 is hingedly connected to frame 352 with a hinge 358. Hinge 358 may be a living hinge that is integrally formed with frame 352 or may be a separately-formed hinge that is attached to frame 352 after it is formed. Hinge 358 allows locking member 354 to pivot between the unlocked position and the locked position.

Each locking member 354 includes an arm 360 and a protrusion 362. Each locking member 354 further includes a locking finger 364 configured to engage frame 352 in a one way snap connection to prevent protrusion 362 from being moved to the unlocked position after protrusion 362 has reached the unlocked position.

In the embodiment of the invention depicted in FIG. 36, arms 360 pivot about an axis that is substantially parallel to the insertion direction of item 206. Each arm 360 is substantially equal to the thickness of frame 352. Each protrusion 362 includes a curved wall 366 that allows protrusion 362 to be pivoted inwardly about the pivot defined by hinge 358. The general radius of wall 366 is substantially equal to the distance between hinge 358 and the wall opposite hinge 358 so that protrusion 362 substantially fills the insertion opening of frame 352 when protrusion 362 is in the locked position. Each locking member 354 thus pivots in a plane substantially perpendicular to the insertion direction of item 206. Once item 206 is fully inserted into frame 352, each locking member 354 is pivoted inwardly until locking fingers 364 engage frame 352 to prevent locking members 354 from pivoting outwardly. Protrusions 362 may include locking fingers 364 on their upper and lower surfaces. Once locking members 354 are in the locked position, item 206 cannot be removed from frame 352 without at least partially destroying frame 352.

Figure 37:
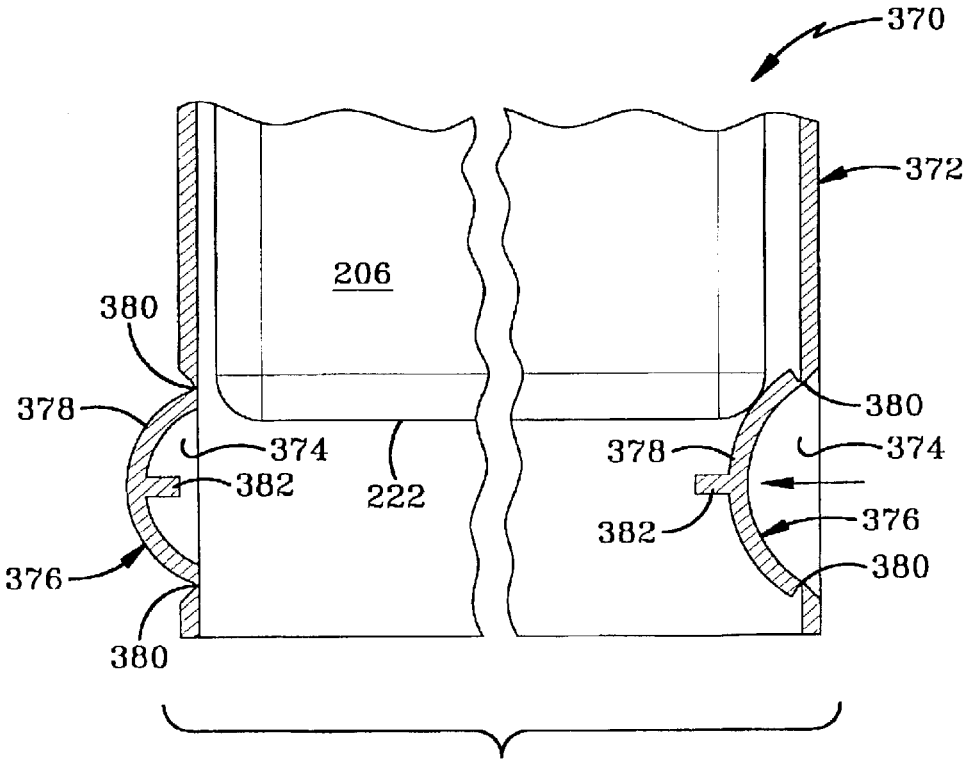
FIG. 37 is a front sectional view of the thirteenth embodiment of the invention with one side locked and one side unlocked.

The thirteenth embodiment of the invention is depicted in FIG. 37 and is indicated generally by the numeral 370. Security sleeve 370 includes a frame 372 that is substantially similar to the other frames described above with respect to the other embodiments of the invention. Frame 372 is configured to slidingly receive item 206 until the bottom wall 222 of item 206 is positioned adjacent the openings 374 of frame 372.

Security sleeve 370 includes a pair of locking members 376 that may be individually moved between the unlocked position (the left side of FIG. 37) and the locked position (the right side of FIG. 37). Each locking member 376 includes an arm 378 that is hinged to frame 372 at its upper arm and its lower end by appropriate hinges 380. Each arm 378 is longer than the space between hinges 380 such that arm 378 will bow outwardly when in the unlocked position and bow inwardly when in the locked position. Arm 378 is flexible enough to be forced through the smaller opening when the user moves arm 378 from the unlocked position to the locked position. Each arm 378 includes a locking finger 382 that extends inwardly and will catch on item 206 to prevent item 206 from being slid out past locking members 376 once locking members 376 are locked.

Hinges 380 are formed to prevent locking members 376 from being moved from the locked position back to the unlocked position. Once locked, security sleeve 370 must be at least partially destroyed before item 206 may be removed.

Figure 38:
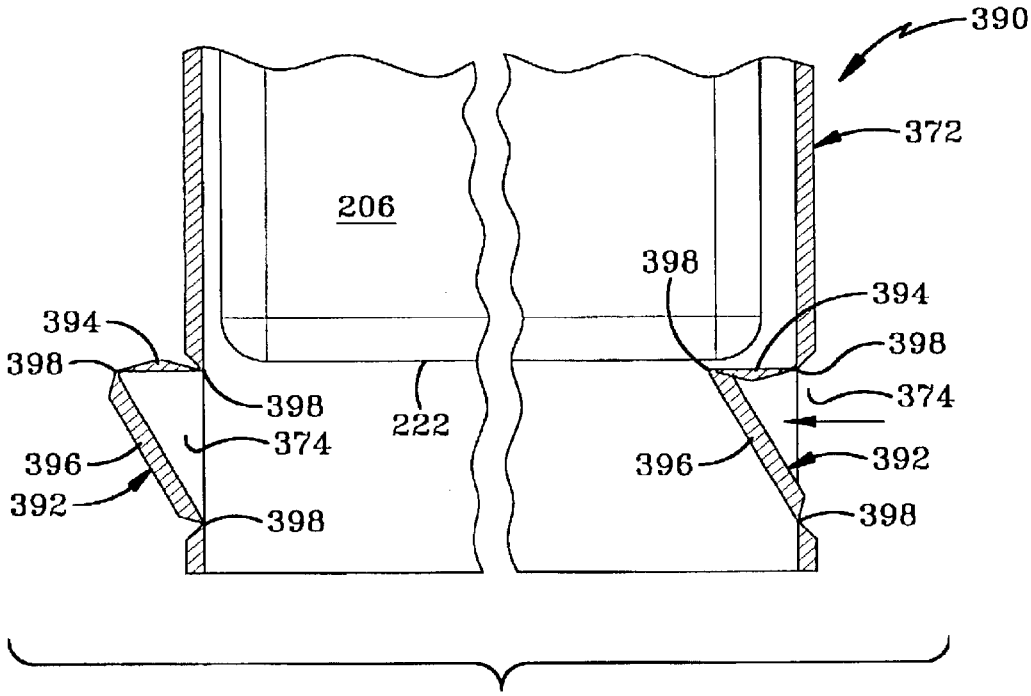
FIG. 38 is a front sectional view of the fourteenth embodiment of the invention with one side locked and one side unlocked.

The fourteenth embodiment of the security sleeve is indicated generally by the numeral 390 in FIG. 38. Security sleeve 390 is similar to security sleeve 370 and the same numbers are used to refer to similar elements. Security sleeve 390 includes a pair of locking members 392 that are each movable between the unlocked position and the locked position. Each locking member 392 includes a pair of arms 394 and 396 that are connected together and to frame 372 with a plurality of hinges 398. The combined length of arms 394 and 396 is longer than the length of opening 374 such that arms 392 and 394 must be forced through opening 374 when locking member 392 is moved from the unlocked position to the locked position. Hinges 398 are configured to prevent locking member 392 from being snapped back from the locked position to the unlocked position. In the configuration depicted in FIG. 38, arm 394 is substantially perpendicular to the insertion direction of item 206 when locking member 392 is in the locked position.

Figure 39:
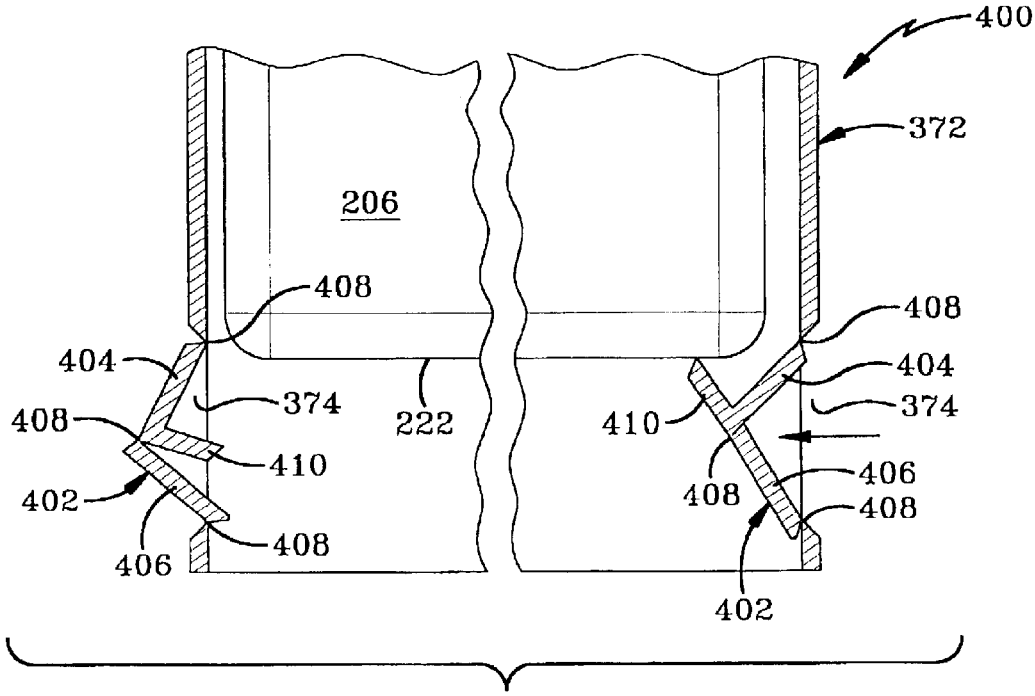
FIG. 39 is a front sectional view of the fifteenth embodiment of the invention with one side locked and one side unlocked.

The fifteenth embodiment of the security sleeve is indicated generally by the numeral 400 in FIG. 39. Security sleeve 400 is similar to security sleeve 390 and similar numbers are referred to similar elements. Security sleeve 400 includes locking members 402 that are each moved between the unlocked position and the locked position to lock security sleeve 400. Each locking member 402 includes a first arm 404 and a second arm 406. Arms 404 and 406 are hinged to each other and to frame 372 by a plurality of appropriate hinges 408. One of arms 404 and 406 includes a locking finger 410 configured to engage or be disposed adjacent bottom wall 222 of item 206 when locking member 402 is in the locked position. Hinges 408 are configured to prevent arms 404 and 406 from being moved from the locked position to the unlocked position.

In each of the above-described three embodiments, the hinges are configured to prevent the locking members from being forced outwardly through the openings in the frames. The configuration of the hinge includes the angles of the arms and frame immediately adjacent the hinges. These angles also allow the arms to abut against each other to provide a strong retaining force for item 206.

Figure 40:
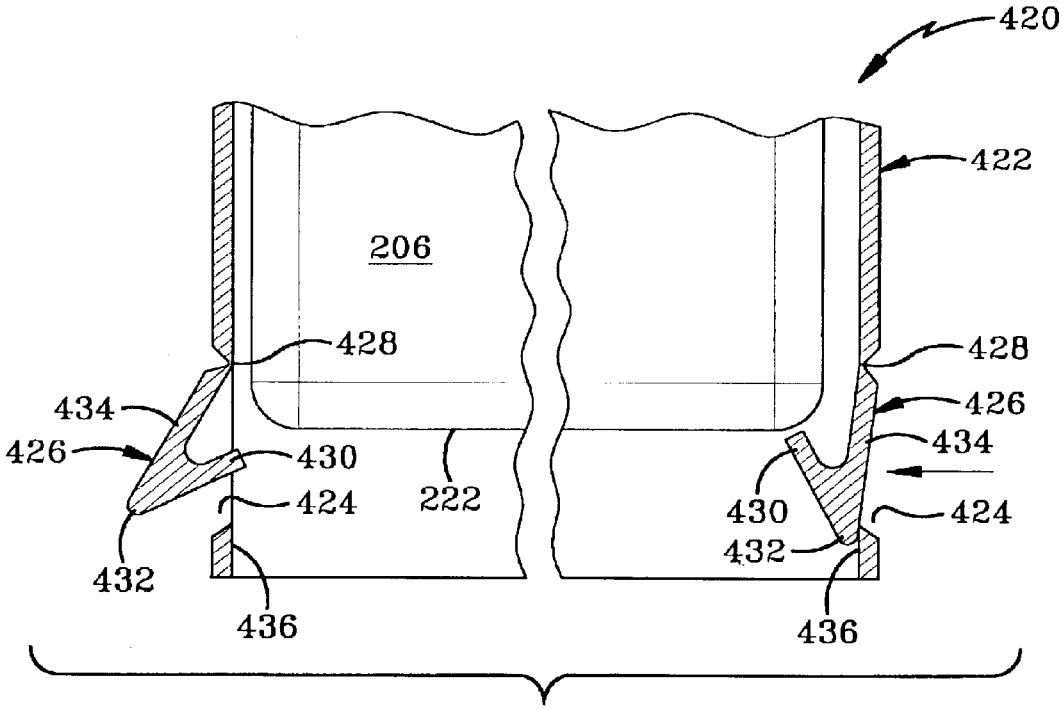
FIG. 40 is a front sectional view of the sixteenth embodiment of the invention with one side locked and one side unlocked.

The sixteenth embodiment of the invention is indicated generally by the numeral 420 in FIG. 40. Security sleeve 420 includes a frame 422 that is similar to the other frames described above. As such, frame 422 defines a pair of openings 424 adjacent the insertion opening and adjacent the lower end 222 of item 206 when item 206 is fully inserted within frame 422.

Security sleeve 420 includes a pair of locking members 426 that are each hingedly attached to frame 422 by an appropriate hinge 428. Each locking member 426 includes an inwardly and upwardly extending locking finger 430 designed to engage item 206 when locking member 426 is in the locked position.

In this embodiment of the invention, the lower end 432 of the arm 434 of each locking member 426 is sized to engage the ledge 436 formed by frame 422 below opening 424 to prevent locking member 426 from being moved from the locked position to the unlocked position.

In this embodiment, item 206 is intended to be inserted into frame 422 immediately after frame 422 is removed from the mold that is used to form frame 422. While frame 422 is relatively warm and flexible, item 206 is inserted into frame 422 and locking members 426 are forced through openings 424. Frame 422 then cools and prevents locking members 426 from being removed back through openings 424. This method of locking the security sleeve may be used with any of the embodiments described above or below. This method allows a secure locked arrangement to be created because the length of arm 434 is significantly longer than the length of opening 424.

The seventeenth embodiment of the security sleeve is indicated generally by the numeral 440 in FIGS. 41–44. Security sleeve 440 includes a frame 442 similar to the frames described with respect to the other embodiments of the invention. Frame 442 is configured to receive item 206 in the same manner described above.

Figure 42:
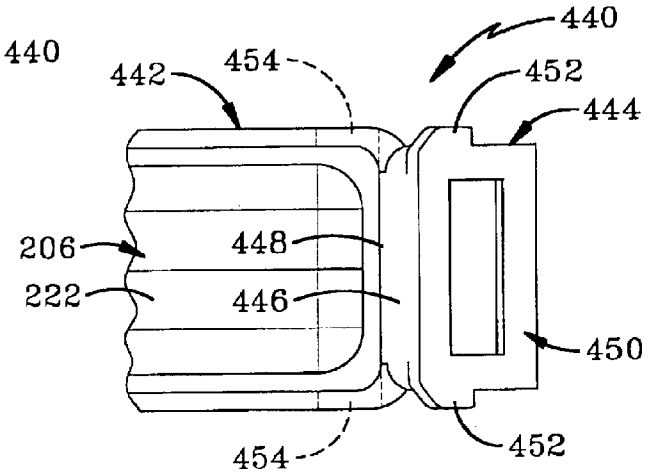
FIG. 42 is a bottom plan view of FIG. 41.
Figure 44:
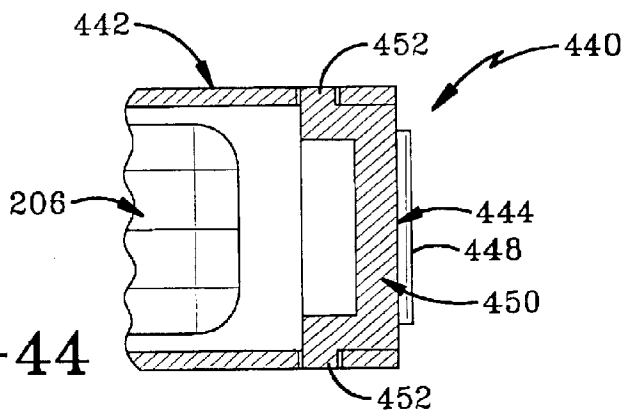
FIG. 44 is a sectional view taken along line 44—44 of FIG. 43.
Figure 43:
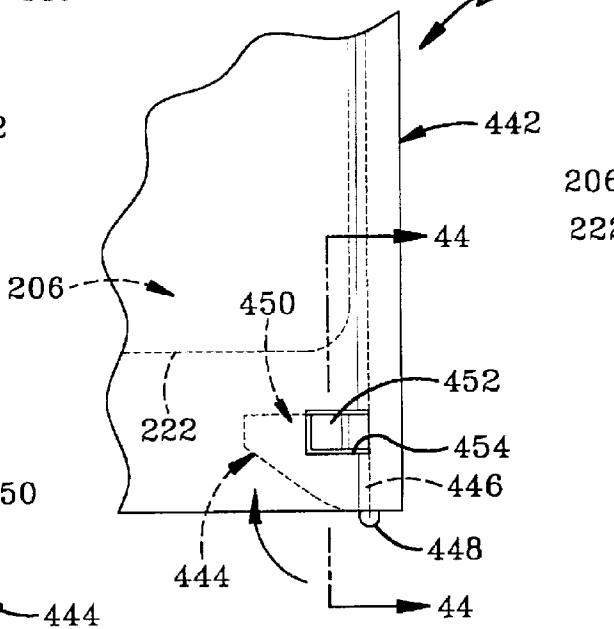
FIG. 43 is a front elevational view of the seventeenth embodiment in the locked position.
Figure 41:
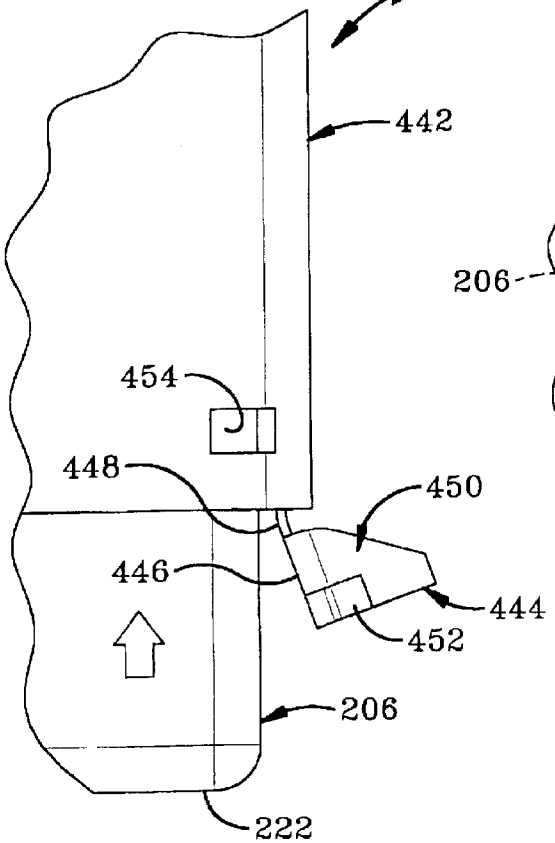
FIG. 41 is a front elevational view of the seventeenth embodiment of the invention in the unlocked position.

Security sleeve 440 includes a pair of locking members 444 that are each movable between the unlocked position depicted in FIGS. 41 and 42 and the locked position depicted in FIGS. 43 and 44. Each locking member 444 includes an arm 446 that is hinged to frame 442 by a hinge 448. In this embodiment, hinge 448 is disposed at the bottom of frame 442 and allows arm 446 to pivot up into the insertion opening of frame 442.

Each locking member 444 further includes a protuberance 450 that fits within the insertion opening of frame 442. Each protuberance 450 includes at least one lock finger 452 that engages an opening 454 defined by frame 442. Lock fingers 452 are configured to engage frame 442 in a one way snap connection that prevents locking members 444 from being moved out of the locked position.

Figure 45:
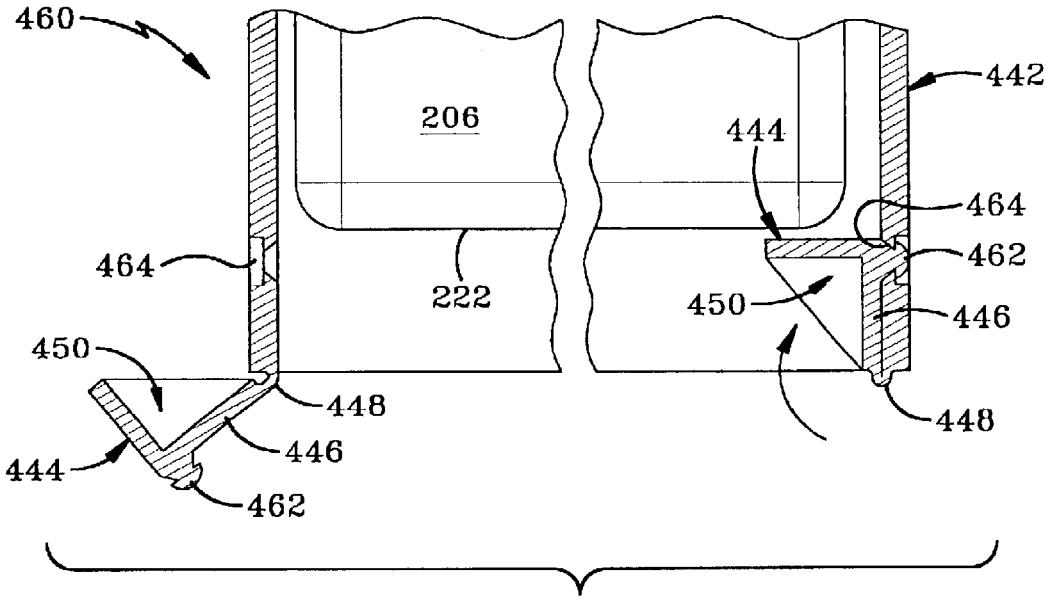
FIG. 45 is a front sectional view of the eighteenth embodiment of the invention with one side locked and one side unlocked.

The eighteenth embodiment of the invention is indicated generally by the numeral 460 in FIG. 45. Security sleeve 460 is similar to security sleeve 440 except that locking members 444 lock with frame 442 in a different manner than in sleeve 440. In sleeve 460, each arm 446 includes a male locking member 462 that snap fits into a female opening 464 formed in frame 442. In another embodiment, male and female locking members 462 and 464 are reversed.

Figure 46:
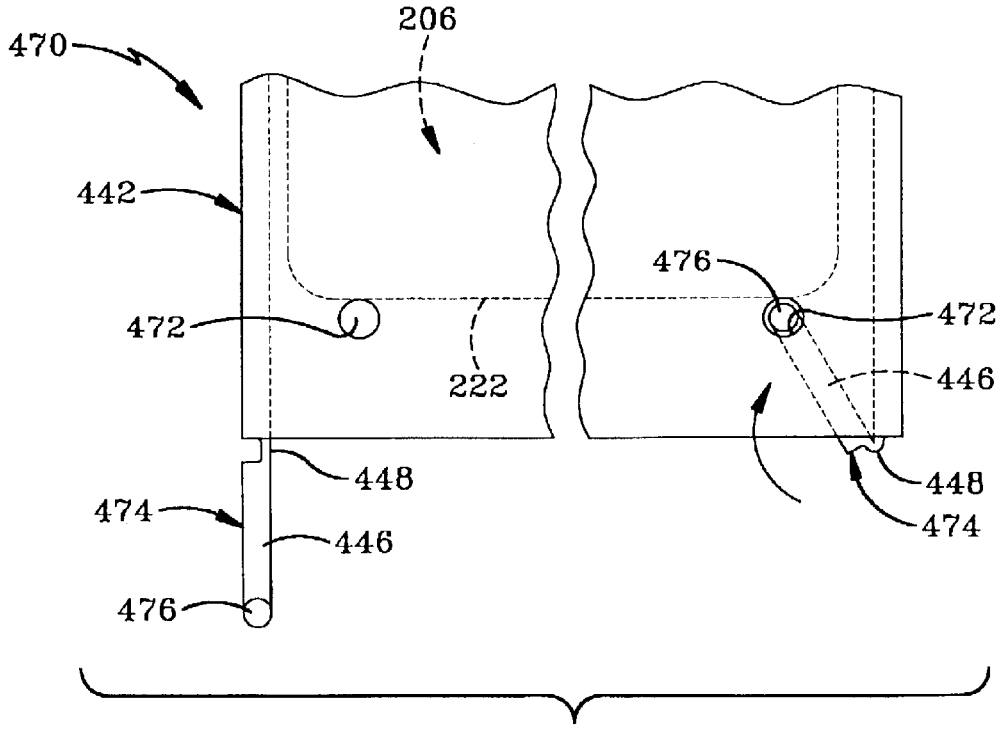
FIG. 46 is a front elevational view of the nineteenth embodiment of the invention with one side locked and one side unlocked.

The nineteenth embodiment of the security sleeve is indicated generally by the numeral 470 in FIG. 46. Security sleeve 470 is similar to the seventeenth and eighteenth embodiments of the invention described above. In the nineteenth embodiment, frame 442 defines four openings 472 in the front and back walls of frame 442 adjacent bottom wall 222 of item 206. Each locking member 474 includes a pair of locking fingers 476 that snap fit into openings 472 when locking members 474 are moved to the locked position.

Figure 47:
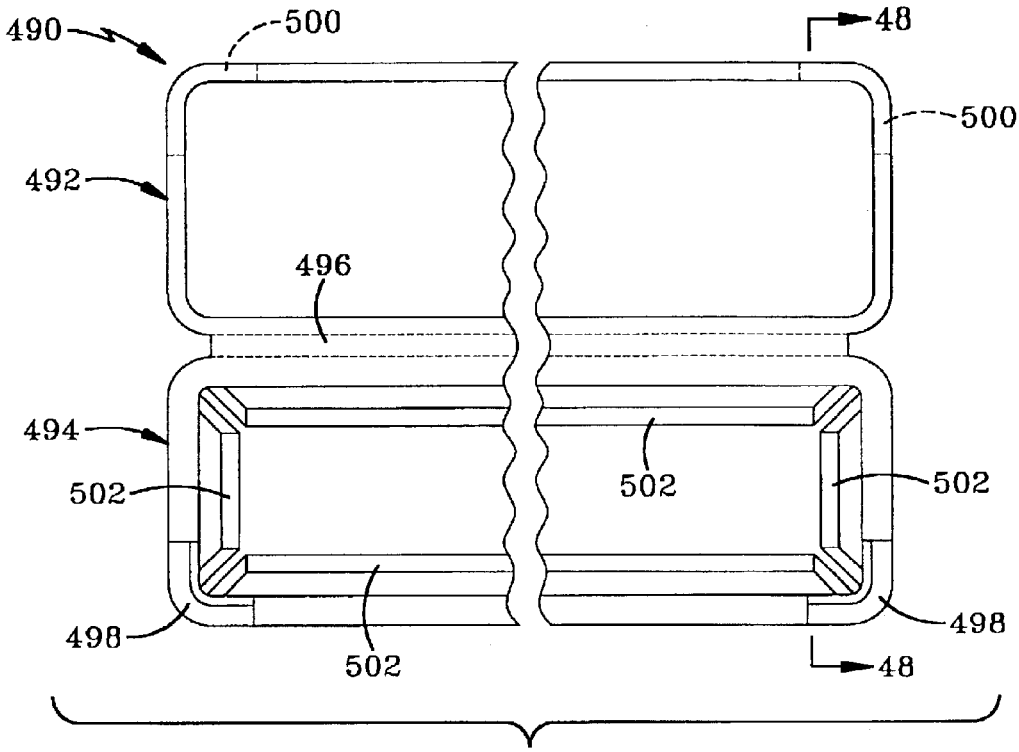
FIG. 47 is a bottom plan view of the twentieth embodiment of the invention in the unlocked position.
Figure 48:
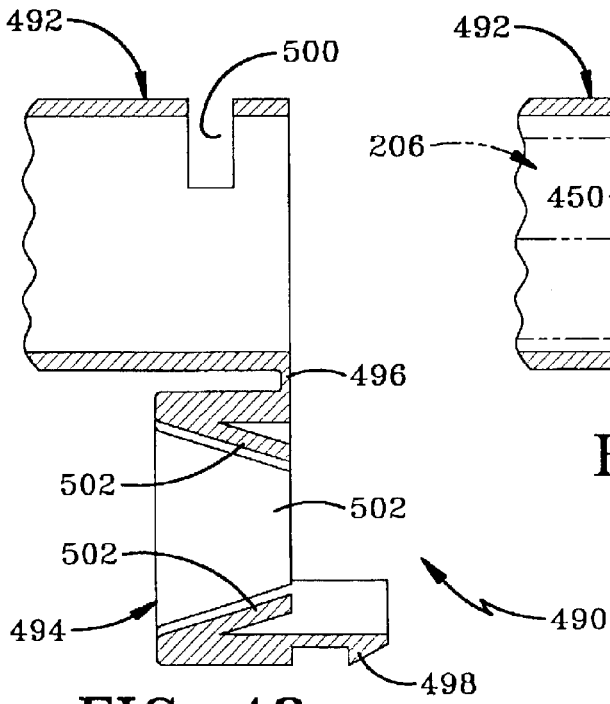
FIG. 48 is a sectional view taken along line 48—48 of FIG. 47.
Figure 49:
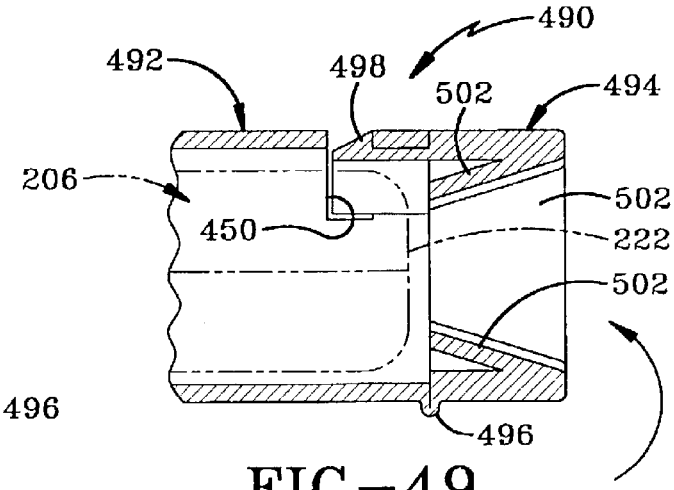
FIG. 49 is a sectional view similar to FIG. 48 showing the locked position.

The twentieth embodiment of the security sleeve of the present invention is indicated generally by the numeral 490 in FIGS. 47–49. Security sleeve 490 generally includes a frame 492 configured to surround item 206 as described above. The insertion opening of frame 492 is locked in this embodiment of the invention with a cap 494 that performs the function of the locking members. Cap 494 is connected to one wall of frame 492 with an appropriate hinge 496. Cap 494 is movable between the unlocked position depicted in FIGS. 47 and 48 and the locked position depicted in FIG. 49. When cap 494 reaches the locked position of FIG. 49, at least one locking finger 498 engages an opening 500 defined by frame 492. Locking finger 498 is received in opening 500 in a one-way snap fit connection that prevents cap 494 from being moved back to the unlocked position. Opening 500 may be disposed in the wall of frame 492 opposite hinge 496 or a plurality of openings 500 may be disposed about frame 492 with a plurality of fingers 498 engaging openings 500. In the embodiment of the invention depicted in FIGS. 47–49, openings 500 are disposed at the corners of frame 492 and fingers 498 are disposed at the corresponding corners of cap 494.

Cap 494 includes a plurality of inwardly disposed locking fingers 502. Locking fingers 502 extend into the insertion opening of frame 492 and prevent item 206 from being removed from frame 492 after cap 494 is in the locked position as depicted in FIG. 49. Locking fingers 502 are preferably angled inwardly and upwardly towards item 206 from the lower end of cap 494. Fingers 502 are sufficiently rigid to prevent a potential shoplifter from prying fingers 502 outwardly or breaking them off. In the embodiment of the invention depicted in the drawings, each locking finger 502 extends substantially the entire length of its corresponding cap 494 sidewall. The edges of each finger 502 are angled so that fingers 502 fit together without interfering with one another.

Figure 51:
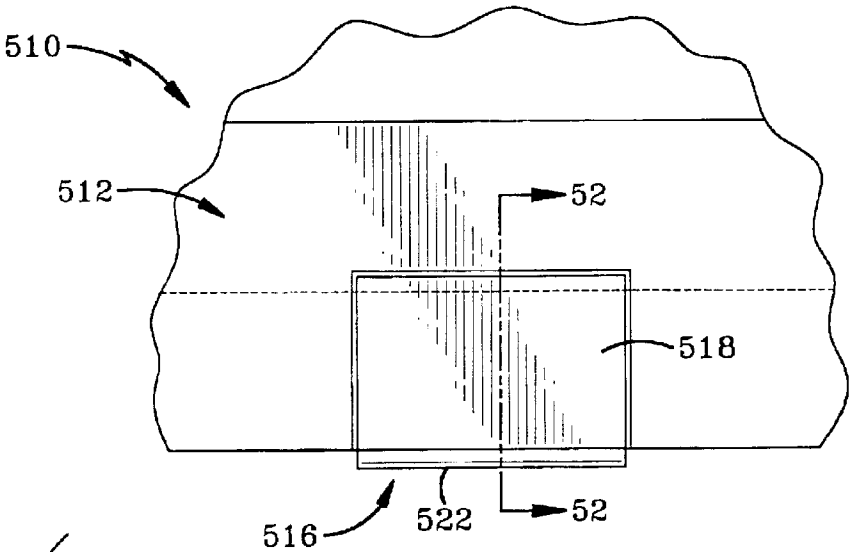
FIG. 51 is a side elevational view of the twenty-first embodiment in the locked position.
Figure 52:
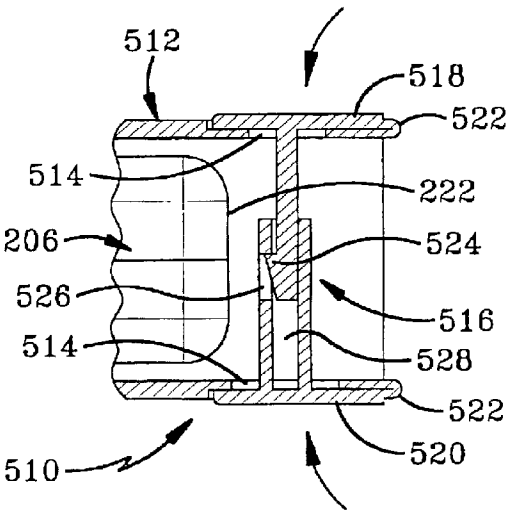
FIG. 52 is a sectional view taken along line 52—52 of FIG. 51.
Figure 50:
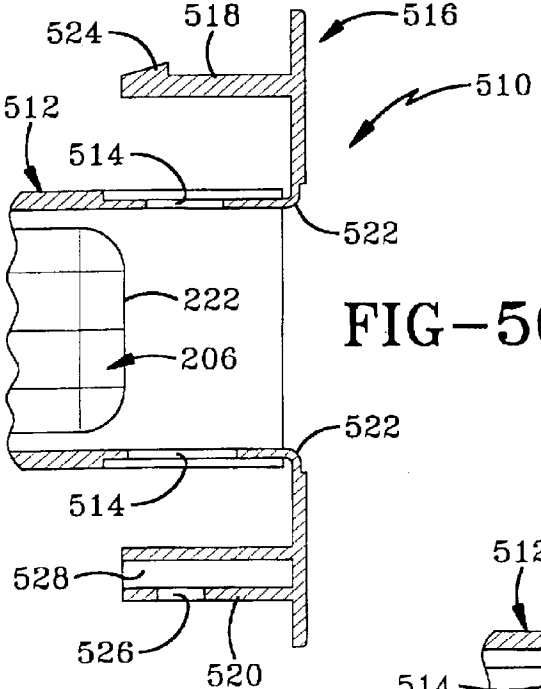
FIG. 50 is a side sectional view of the twenty-first embodiment of the invention in the unlocked position.

The twenty-first embodiment of the security sleeve of the present invention is indicated generally by the numeral 510 in FIGS. 50–52. Security sleeve 510 includes a frame 512 similar to the frames described above with respect to the other embodiments of the invention. Frame 512 defines openings 514 positioned below the fully inserted position of bottom wall 222 of item 206. Openings 514 may be stepped as depicted in the drawings in some embodiments of the invention.

Security sleeve 510 includes at least one locking member 516 that includes a male locking member 518 and a female locking member 520 that fit together in the locked position (FIG. 52) to lock item 206 in frame 512. Each locking member 518 and 520 is connected to frame 512 by an appropriate hinge 522 so that each member 518 and 520 may pivot between an unlocked position (FIG. 50) and a locked position (FIG. 52).

Male locking member 518 includes at least one locking finger 524 configured to be lockingly received in a one way snap fit connection with an opening 526 defined by female locking member 520. In this embodiment, female locking member 520 includes a longitudinal opening 528 that receives locking finger 524.

Figure 54:
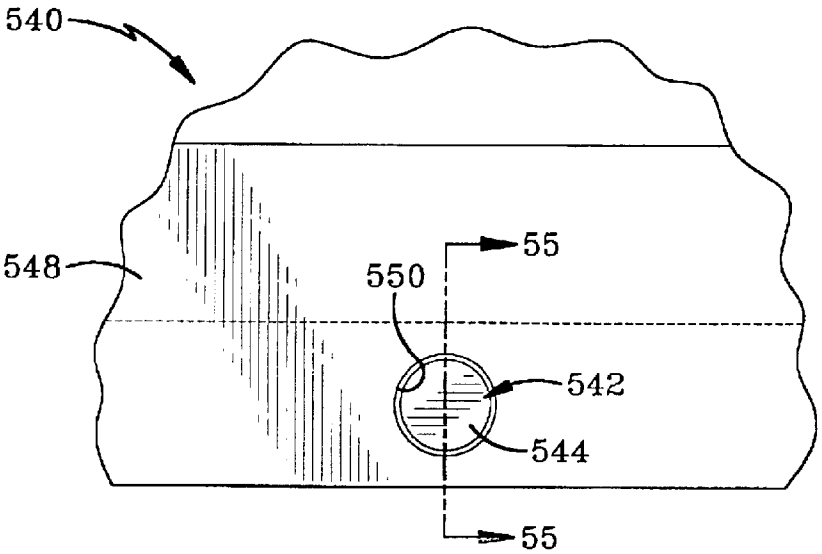
FIG. 54 is a side elevational view of the twenty-second embodiment in the locked position.
Figure 55:
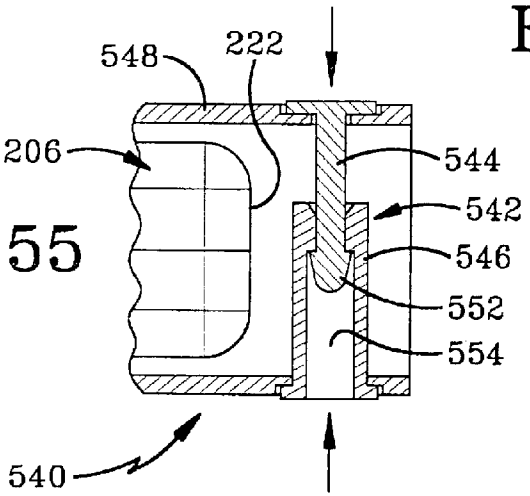
FIG. 55 is a sectional view taken along line 55—55 of FIG. 54.
Figure 53:
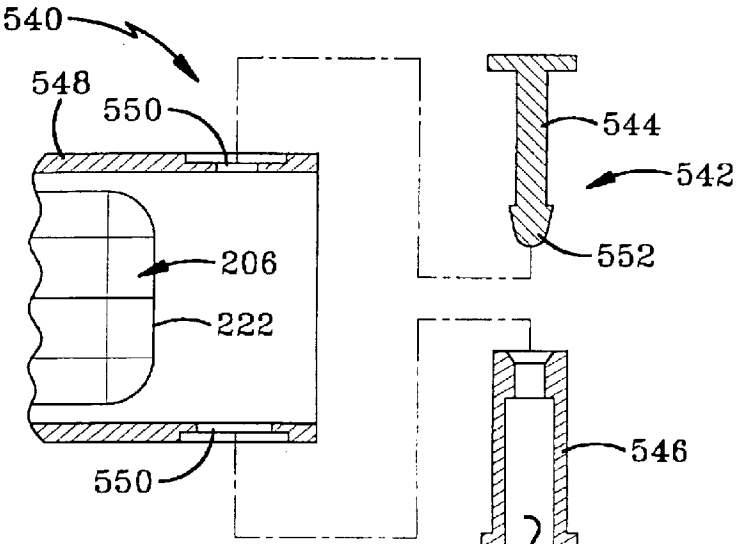
FIG. 53 is a side sectional view of the twenty-second embodiment of the invention in the unlocked position.

The twenty-second embodiment of the security sleeve is depicted in FIGS. 53–55 and is indicated generally by the numeral 540. Security sleeve 540 is similar to security sleeve 510 except that locking member 542 having a male locking member 544 and a female locking member 546 is not hingedly connected to frame 548. Locking member 542 passes through openings 550 defined by frame 548. In the locked position depicted in FIG. 55, locking member 542 prevents item 206 from being removed from frame 548. A shoplifter cannot remove locking member 542 because male locking member 544 includes a locking finger 552 that is received in a one way snap fit connection in an opening 554 defined by female locking member 546. Security sleeve 540 may use a single or a plurality of locking members 542 disposed across the insertion opening of frame 548.

Figure 56:
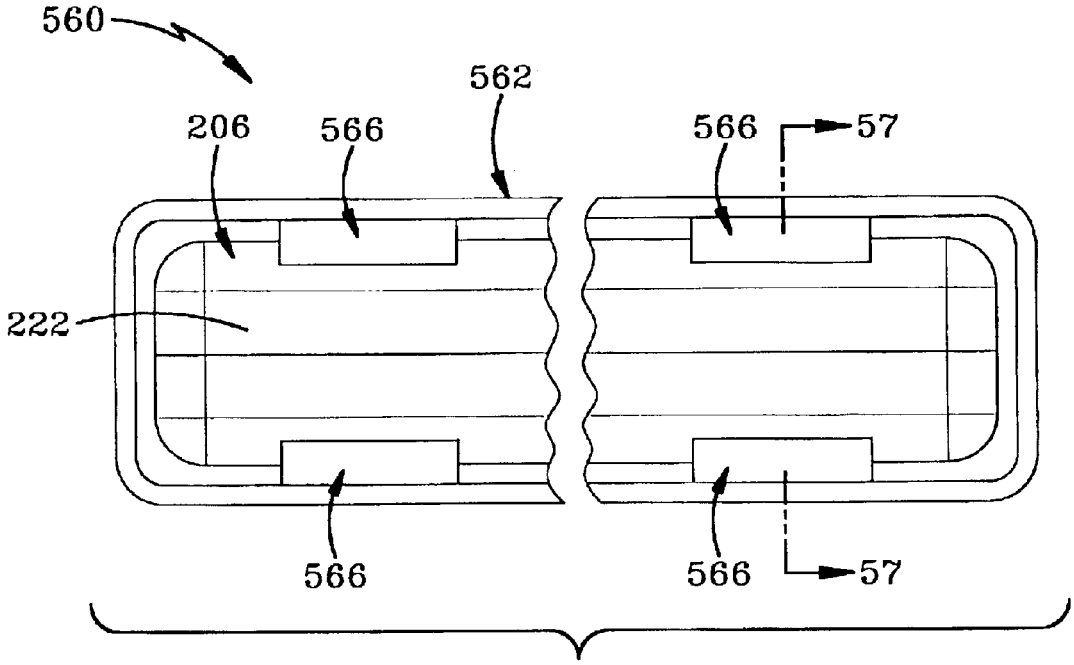
FIG. 56 is a bottom plan view of the twenty-third embodiment of the invention.
Figure 57:
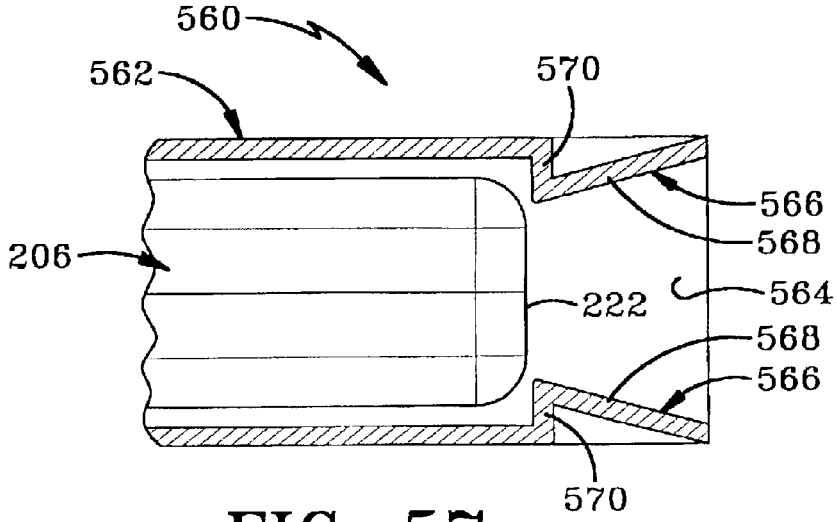
FIG. 57 is a sectional view taken along line 57—57 of FIG. 56.

The twenty-third embodiment of the security sleeve is indicated generally by the numeral 560 in FIGS. 56 and 57. Security sleeve 560 includes a frame 562 similar to the other frames described in this application. Frame 562 includes an insertion opening 564 wherein item 206 may be inserted into frame 562 in a manner that prevents item 206 from being removed without destroying a portion of frame 562. In this embodiment, the locking members are at least one locking finger 566 that is integrally formed in frame 562. Locking finger 566 includes an angled insertion wall 568 and a ledge wall 570 that prevents item 206 from being moved out of frame 562. Each locking finger 566 is configured to allow item 206 to be forced through fingers 566 based on the resiliency and flexibility of the material that forms frame 562. Each ledge 570 is configured to prevent item 206 from being removed without destroying a portion of frame 562.

Figure 58:
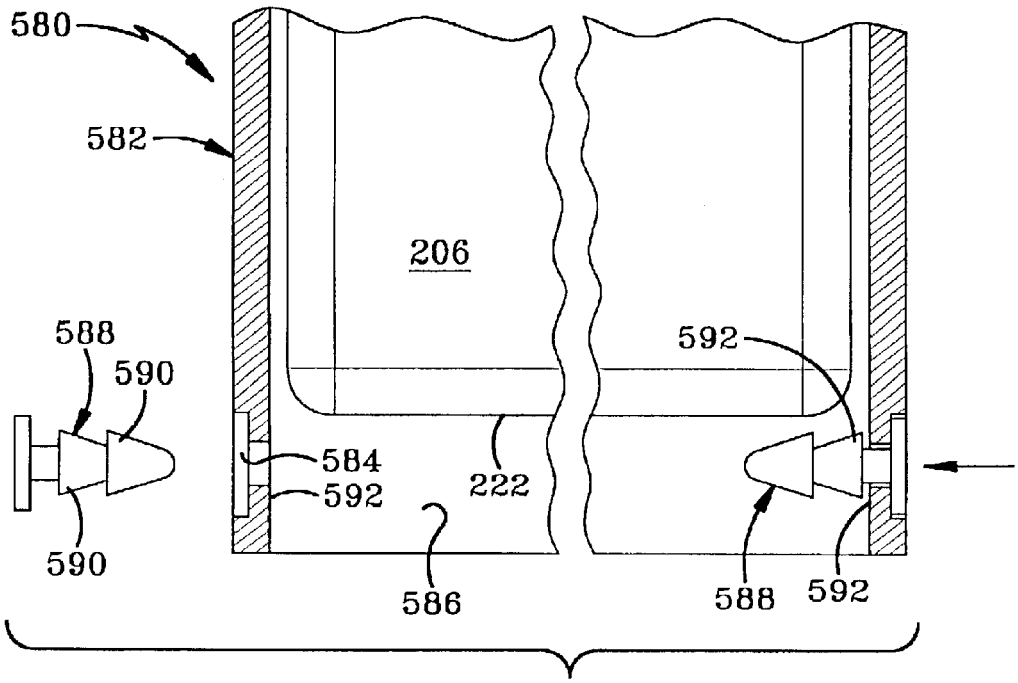
FIG. 58 is a front sectional view of the twenty-fourth embodiment with one side locked and one side unlocked.

The twenty-fourth embodiment of the security sleeve is indicated generally by the numeral 580 in FIG. 58. Security sleeve 580 includes a frame 582 similar to the other frames described in the specification. Frame 582 defines a pair of openings 584 adjacent the insertion opening 586 of frame 582.

Security sleeve 580 includes at least one locking mechanism 588 that is configured to be received in opening 584 in a one way snap connection to allow locking member 588 to be inserted into frame 582 while preventing locking member 588 from being removed from frame 582. Locking member 588 thus includes at least one locking finger 590 that is angled to allow locking member 588 to be inserted through opening 584 while engaging the ledge 592 formed by frame 582 immediately adjacent opening 584. Each locking member 588 is configured to block enough of insertion opening 586 to prevent item 206 from being removed from frame 582 without destroying a portion of frame 582.

Figure 59:
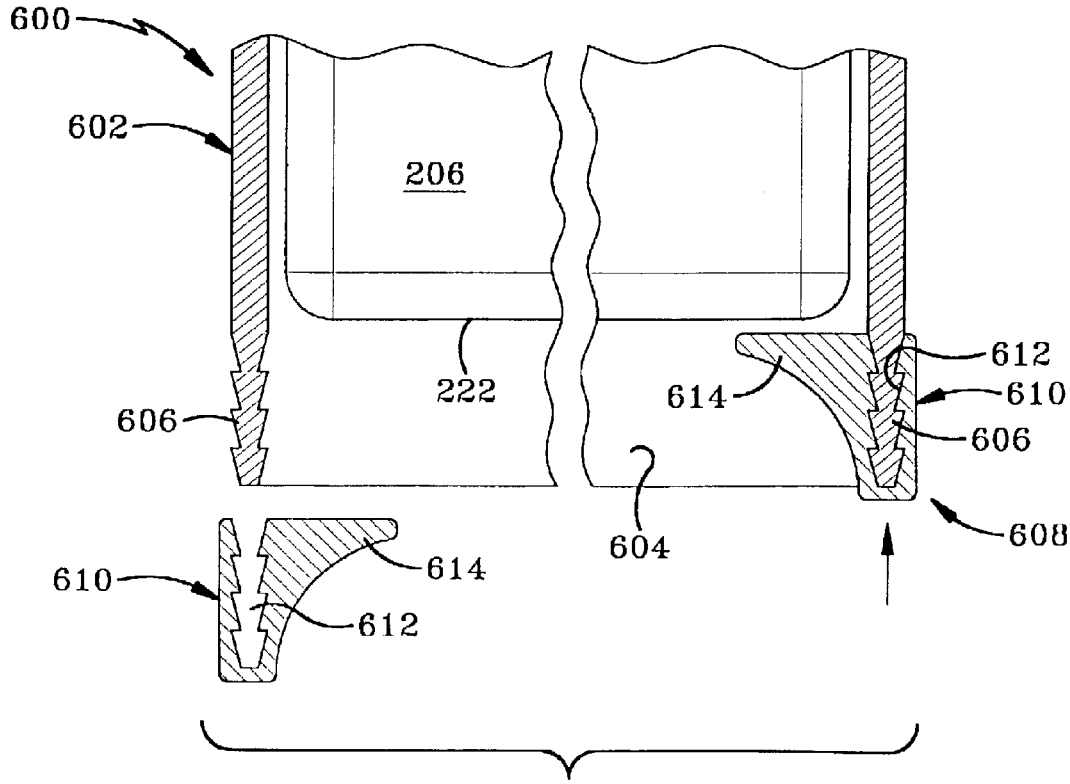
FIG. 59 is a front sectional view of the twenty-fifth embodiment of the invention with one side locked and one side unlocked.

The twenty-fifth embodiment of the security sleeve is indicated generally by the numeral 600 in FIG. 59. Security sleeve 600 includes a frame 602 similar to the other frames described in the specification. Frame 602 defines an insertion opening 604 where item 206 may be inserted into frame 602. At least one portion of frame 602 adjacent insertion opening 604 includes a first portion 606 of a locking member 608. In the embodiment depicted in FIG. 59, first portion 606 is in the form of a plurality of male locking fingers configured to be received in a one way snap fit connection in a second locking member portion 610 that includes a female opening 612 having corresponding locking fingers. Second locking member portion 610 includes a protrusion 614 that extends out into insertion opening 604 to prevent item 206 from being removed from frame 602. Locking member 608 may be formed on the ends of frame 602 as depicted in FIG. 59 or on the sidewalls intermediate at the ends.

Figure 60:
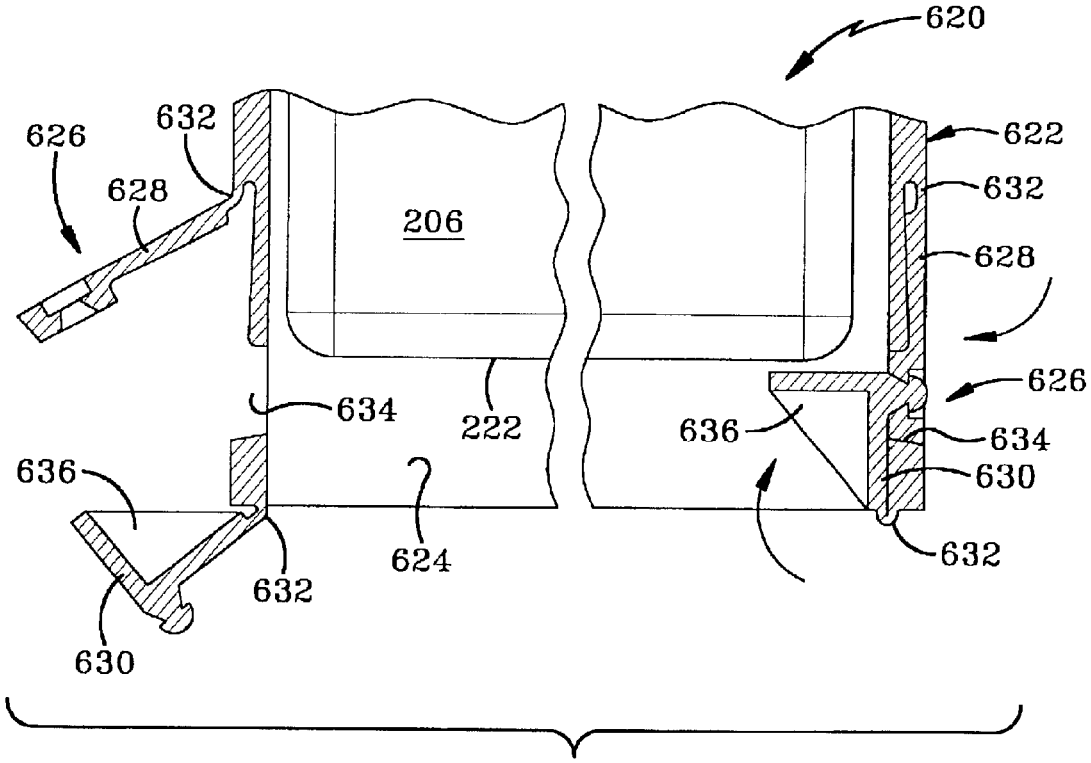
FIG. 60 is a front sectional view of the twenty-sixth embodiment of the invention with one side locked and one side unlocked.

The twenty-sixth embodiment of the security sleeve is indicated generally by the numeral 620 in FIG. 60. Security sleeve 620 includes a frame 622 similar to the other frames described from this application. Frame 622 defines an insertion opening 624 where item 206 may be inserted into frame 622.

Security sleeve 620 includes at least one locking member 626 that may be moved from an unlocked position (the left side of FIG. 60) to a locked position (the right side of FIG. 60). Each locking member 626 includes a first arm 628 and a second arm 630. Each arm 628 and 630 is connected to frame 622 by an appropriate hinge 632. Arm 628 includes a female lock opening while arm 630 includes a male lock finger. Lock member 626 is moved from the unlocked position to the locked position by pivoting arm 628 down and inwardly towards an opening 634 defined by frame 622. Arm 630 is then pivoted upwardly and outwardly until the male locking finger of arm 630 engages the female lock opening of arm 628 to lock arms 628 and 630 together in the locked position as depicted on the right side of FIG. 60. Each arm 630 includes a protrusion 636 that prevents item 206 from being removed from frame 622.

In each of the embodiments of the invention described above, the frames included a single insertion opening where item 206 was inserted into the frame. The inventors also contemplate a sleeve having a pair of openings with lock members disposed at each opening so that item 206 may be inserted into either opening. A lock member that is used with the openings may be the same or different depending on the application for the invention. The lock members of these embodiments may be combined together to cooperate to hold item 206 within the frame. Further, different numbers of lock members may be used without departing from the concepts of the invention. In most cases, pairs of lock members are used on the end walls. The inventors contemplate that a single lock member may be used to provide a secure frame with the single lock member being disposed on any of the walls of the frame. The inventors further contemplate that three, four, five, six, or more lock members may be used to lock item 206 within the frame.

Accordingly, the improved security sleeve for recorded media storage containers apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the security sleeve for recorded media storage containers is constructed and used, the characteristics of the construction, and the advantageous new and useful results obtained; the new and useful structures, devices, elements, arrangements, parts, and combinations are set forth in the appended claims.

What is claimed is:

1. A security sleeve for displaying an item of merchandise; the item of merchandise having top and bottom edges defining a length, side edges defining a width, and front and back surfaces defining a thickness; the security sleeve comprising:

a frame defining a storage compartment and an insertion opening;

the storage compartment adapted to receive the item of merchandise;

the insertion opening adapted to permit insertion of the item of merchandise into the storage compartment of the frame;

the frame including opposed walls;

each wall defining an opening;

a locking member pivotally connected to each wall adjacent the opening;

each locking member being movable between unlocked and locked positions;

each locking member being disposed outside the storage compartment when in the unlocked position;

each locking member including a locking finger that lockingly engages the inner surface of the wall adjacent the opening when the locking member is in the locked position;

the locking fingers being disposed across a portion of the insertion opening when the locking members are in the locked position; and the locking fingers being adapted to prevent the item of merchandise from being removed from the storage compartment when the locking member is in the locked position.

2. The security sleeve of claim 1, wherein the openings in the opposed walls are directly across the insertion opening from each other.

3. The security sleeve of claim 1, wherein each wall has an outer surface and each locking member has an outer surface; the outer surface of the locking member being substantially flush with the outer surface of the wall when the locking member is in the locked position.

4. The security sleeve of claim 3, wherein each wall has a longitudinal direction; the pivot axis between the locking member and the wall being perpendicular to the longitudinal direction of the wall.

5. The security sleeve of claim 4, wherein the locking member includes at least two locking fingers that engage the frame when the locking member is in the locked position to prevent the locking member from being moved back to the unlocked position.

6. The security sleeve of claim 5, wherein the locking member includes four locking fingers that engage the frame when the locking member is in the locked position to prevent the locking member from being moved back to the unlocked position.

7. The security sleeve of claim 5, wherein the locking member defines an opening intermediate the two fingers.

8. The security sleeve of claim 5, wherein the two locking fingers are spaced apart.

9. The security sleeve of claim 1, wherein the locking members are integrally formed with the frame.

10. A security sleeve for displaying an item of merchandise; the item of merchandise having top and bottom edges defining a length, side edges defining a width, and front and back surfaces defining a thickness; the security sleeve comprising:

a frame defining a storage compartment and an insertion opening;

the storage compartment adapted to receive the item of merchandise;

the insertion opening adapted to permit insertion of the item of merchandise into the storage compartment of the frame;

the frame including opposed walls;

each wall defining an opening;

a locking member pivotally connected to each wall adjacent the opening;

each locking member being movable between unlocked and locked positions;

each locking member being disposed outside the storage compartment when in the unlocked position;

each locking member including a pair of oppositely extending locking fingers that lockingly engage the inner surface of the wall adjacent the opening when the locking member is in the locked position;

the locking fingers being disposed across a portion of the insertion opening when the locking members are in the locked position; and the locking fingers being adapted to prevent the item of merchandise from being removed from the storage compartment when the locking member is in the locked position.

11. The security sleeve of claim 10, wherein the openings in the opposed walls are directly across the insertion opening from each other.

12. The security sleeve of claim 10, wherein each wall has an outer surface and each locking member has an outer surface; the outer surface of the locking member being substantially flush with the outer surface of the wall when the locking member is in the locked position.

13. The security sleeve of claim 10, wherein each wall has a longitudinal direction; the pivot axis between the locking member and the wall being perpendicular to the longitudinal direction of the wall.

14. The security sleeve of claim 10, wherein each locking member includes four locking fingers that engage the frame when the locking member is in the locked position to prevent the locking member from being moved back to the unlocked position.

15. The security sleeve of claim 10, wherein the locking member defines an opening intermediate the two fingers.

16. The security sleeve of claim 15, wherein the two locking fingers are spaced apart.

17. The security sleeve of claim 10, wherein the locking members are integrally formed with the frame.

* * * * *